US010395447B2

(12) United States Patent
Miura et al.

(10) Patent No.: US 10,395,447 B2
(45) Date of Patent: Aug. 27, 2019

(54) DATA COLLECTION DEVICE, WORKING MACHINE HAVING DATA COLLECTION DEVICE, AND SYSTEM USING DATA COLLECTION DEVICE

(71) Applicant: KUBOTA CORPORATION, Osaka (JP)

(72) Inventors: Keisuke Miura, Osaka (JP); Isao Tanaka, Osaka (JP); Kazuo Sakaguchi, Osaka (JP); Yoshito Hayakawa, Osaka (JP); Takafumi Morishita, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 277 days.

(21) Appl. No.: 14/780,056

(22) PCT Filed: Sep. 12, 2014

(86) PCT No.: PCT/JP2014/074237
§ 371 (c)(1),
(2) Date: Sep. 25, 2015

(87) PCT Pub. No.: WO2015/045910
PCT Pub. Date: Apr. 2, 2015

(65) Prior Publication Data

US 2016/0055688 A1 Feb. 25, 2016

(30) Foreign Application Priority Data

Sep. 30, 2013 (JP) ..... 2013-203165
Nov. 20, 2013 (JP) ..... 2013-240003

(51) Int. Cl.
*G07C 5/08* (2006.01)
*G06Q 50/02* (2012.01)
(Continued)

(52) U.S. Cl.
CPC ..... *G07C 5/085* (2013.01); *G06Q 50/02* (2013.01); *G07C 3/08* (2013.01); *G07C 5/00* (2013.01); *G07C 5/0858* (2013.01); *G07C 5/008* (2013.01)

(58) Field of Classification Search
CPC .. G06Q 50/02; B60R 16/023; B60R 16/0231; B60R 16/0232; B60R 16/0234;
(Continued)

(56) References Cited

U.S. PATENT DOCUMENTS

2008/0052321 A1 2/2008 Nakase
2012/0095642 A1 4/2012 Nishida
(Continued)

FOREIGN PATENT DOCUMENTS

DE 10321529 12/2004
EP 1258839 11/2002
(Continued)

OTHER PUBLICATIONS

Search Report from PCT/JP2014/074237, dated Dec. 2, 2014.
(Continued)

*Primary Examiner* — Laura N Nguyen
(74) *Attorney, Agent, or Firm* — Greenblum & Bernstein, P.L.C.

(57) ABSTRACT

To properly manage data collected by a data collection device even when the data collection device is attached to an agricultural machine different from a specified agricultural machine.

A data collection device (5) mounted on an agricultural machine (4) having unique agricultural machine identification information (61*a*), the data collection device (5) being capable of collecting data relating to the agricultural machine (4), includes: an identification information retaining part (51) configured to retain second identification
(Continued)

information used for identifying the agricultural machine (4); a check part (55*a*) configured to check the agricultural machine identification information (61*a*) with the second identification information retained in the identification information retention part (51), the agricultural machine identification information (61*a*) being retained in the agricultural machine (4); and a data collection processing part (56*a*) configured to carry out, based on a check result by the check part (55*a*), a process relating to collection of the data.

4 Claims, 22 Drawing Sheets

(51) Int. Cl.
*G07C 3/08* (2006.01)
*G07C 5/00* (2006.01)

(58) Field of Classification Search
CPC ..... B60R 16/0239; B64D 2045/0065; B64D 2045/0085; B64F 5/40; B64F 5/60
See application file for complete search history.

(56) References Cited

U.S. PATENT DOCUMENTS

2013/0058463 A1* 3/2013 Wahl ..... H04L 12/2878 379/9
2013/0151170 A1* 6/2013 Uchida ..... G06Q 10/06 702/33
2013/0212440 A1* 8/2013 Rom ..... G06F 11/0709 714/47.1
2015/0052581 A1 2/2015 Miura et al.
2015/0052591 A1 2/2015 Miura et al.
2016/0169771 A1* 6/2016 Hiruta ..... G05B 23/0243 702/183

FOREIGN PATENT DOCUMENTS

| | | |
|---|---|---|
| JP | 6-68274 | 3/1994 |
| JP | 8-315197 | 11/1996 |
| JP | 9-32628 | 2/1997 |
| JP | 2002-163180 | 6/2002 |
| JP | 2006-70921 | 3/2006 |
| JP | 2006-260331 | 9/2006 |
| JP | 2007-305064 | 11/2007 |
| JP | 2008-53969 | 3/2008 |
| JP | 2011-159232 | 8/2011 |
| JP | 5111184 | 10/2012 |
| JP | 2013-97568 | 5/2013 |
| WO | 2008/040686 | 4/2008 |
| WO | 2013/134615 | 9/2013 |

OTHER PUBLICATIONS

Office Action issued in Japan Counterpart Patent Appl. No. 2013-240003, dated Feb. 28, 2017.
Official Communication issued in European Patent Office (EPO) Patent Application No. 14849658.1, dated Aug. 25, 2017.

* cited by examiner

Fig.3

90

Collection data retention part of the collection device 5a

| Hour meter | Operation information(Operation data) | | |
|---|---|---|---|
| | Vehicle speed (km/h) | PTO revolution speed (rpm) | Fertilizer distribution amount (kg) |
| ⋮ | ⋮ | ⋮ | ⋮ |
| 13:20:00 | 1.50 | 318 | 0.08 |
| 13:20:01 | 1.51 | 325 | 0.09 |
| 13:20:02 | 1.50 | 320 | 0.08 |
| ⋮ | ⋮ | ⋮ | ⋮ |
| 13:32:57 | 1.50 | 318 | 0.08 |
| 13:32:58 | 1.51 | 325 | 0.09 |
| 13:32:59 | 1.50 | 320 | 0.08 |
| | | | |
| 13:45:18 | 1.50 | 318 | 0.08 |
| 13:45:19 | 1.51 | 325 | 0.09 |
| 13:45:20 | 1.50 | 320 | 0.08 |
| ⋮ | ⋮ | ⋮ | ⋮ |
| 13:53:24 | 1.50 | 325 | 0.08 |
| 13:53:25 | 1.51 | 320 | 0.09 |
| 13:53:26 | 1.50 | 318 | 0.08 |

210

211

91

Collection data retention part of the collection device 5b

| Hour meter | Operation information(Operation data) | | |
|---|---|---|---|
| | Vehicle speed (km/h) | PTO revolution speed (rpm) | Fertilizer distribution amount (kg) |
| ⋮ | ⋮ | ⋮ | ⋮ |
| 98:10:10 | 1.70 | 348 | 0.04 |
| 98:10:11 | 1.71 | 355 | 0.05 |
| 98:10:12 | 1.70 | 350 | 0.04 |
| ⋮ | ⋮ | ⋮ | ⋮ |
| 98:22:47 | 1.70 | 348 | 0.04 |
| 98:22:48 | 1.71 | 355 | 0.05 |
| 98:22:49 | 1.70 | 350 | 0.04 |
| | | | |
| 98:45:13 | 1.80 | 348 | 0.04 |
| 98:45:14 | 1.81 | 355 | 0.05 |
| 98:45:15 | 1.80 | 350 | 0.04 |
| ⋮ | ⋮ | ⋮ | ⋮ |
| 99:03:14 | 1.80 | 355 | 0.04 |
| 99:03:15 | 1.81 | 350 | 0.05 |
| 99:03:16 | 1.80 | 348 | 0.04 |

220

221

Fig.4

Collection data

| Hour meter | Operation information(Operation data) | | | |
|---|---|---|---|---|
| | Vehicle speed (km/h) | PTO revolution speed (rpm) | Fertilizer distribution amount (kg) | |
| ⋮ | ⋮ | ⋮ | ⋮ | |
| 98:10:10 | 1.70 | 348 | 0.04 | 220 |
| 98:10:11 | 1.71 | 355 | 0.05 | |
| 98:10:12 | 1.70 | 350 | 0.04 | |
| ⋮ | ⋮ | ⋮ | ⋮ | |
| 98:22:47 | 1.70 | 348 | 0.04 | |
| 98:22:48 | 1.71 | 355 | 0.05 | |
| 98:22:49 | 1.70 | 350 | 0.04 | |
| | | | | |
| 98:45:13 | 1.80 | 348 | 0.04 | 221 |
| 98:45:14 | 1.81 | 355 | 0.05 | |
| 98:45:15 | 1.80 | 350 | 0.04 | |
| ⋮ | ⋮ | ⋮ | ⋮ | |
| 99:03:14 | 1.80 | 355 | 0.04 | |
| 99:03:15 | 1.81 | 350 | 0.05 | |
| 99:03:16 | 1.80 | 348 | 0.04 | |
| ⋮ | ⋮ | ⋮ | ⋮ | |
| F 99:05:10 | 1.50 | 325 | 0.09 | 230 |
| 99:05:11 | 1.51 | 322 | 0.09 | |
| 99:05:12 | 1.50 | 320 | 0.08 | |
| ⋮ | ⋮ | ⋮ | ⋮ | |
| F 99:48:47 | 1.50 | 320 | 0.08 | |
| 99:48:48 | 1.51 | 318 | 0.09 | |
| 99:48:49 | 1.52 | 325 | 0.08 | |
| | | | | |

Fig.10

Parameter group

| | |
|---|---|
| Group name | Engine |
| Communication speed | 2ms |
| Data size | 8bite |
| First identification information (PGN) | 642239 |
| Parameter 1 | Error exist. |
| Parameter 2 | Engine speed |
| Parameter 3 | Coolant temp. |

Fig.11

Group obtaining table

| | |
|---|---|
| Group name | Engine |
| PGN | 642239 |
| Error exist. | None |
| Engine speed [rpm] | 805 |
| Coolant temp. [°C] | 55 |

Fig. 15

Definition file

| Individual parameter Second identification information ParN | Parameter group First identification information PGN | Individual save condition | |
|---|---|---|---|
| | | Current state save condition | Log save condition |
| ▪ | ▪ | ▪ | ▪ |
| ▪ | ▪ | ▪ | ▪ |
| ▪ | ▪ | ▪ | ▪ |
| 9 | 642238 | Every n times of receiveing | At KeyOff |
| 10 | 642238 | At changing of particular Par | Every n times of current value |
| 11 | 642239 | At changing of particular Par | Every n times of current value |
| 12 | 642239 | Every n times of receiveing | Every t hours |
| 13 | 642239 | Every n times of receiveing | Every t hours |
| ▪ | ▪ | ▪ | ▪ |
| ▪ | ▪ | ▪ | ▪ |
| ▪ | ▪ | ▪ | ▪ |

Fig. 16

Definition file

| Individual parameter Second identification information ParN | Parameter group First identification information PGN | Calculation condition | Individual save condition | |
|---|---|---|---|---|
| | | | Current state save condition | Log save condition |
| ⋮ | ⋮ | ⋮ | ⋮ | ⋮ |
| 9 | 642238 | Counting | Every n times of receiveing | At KeyOff |
| 10 | 642238 | — | At changing of particular Par | Every n times of current value |
| 11 | 642239 | — | At changing of particular Par | Every n times of current value |
| 12 | 642239 | Frequency | Every n times of receiveing | Every t hours |
| 13 | 642239 | Statistics | Every n times of receiveing | Every t hours |
| ⋮ | ⋮ | | ⋮ | ⋮ |

Fig.20

| Setting condition | |
|---|---|
| Save condition | Calculation condition |
| Every n times of receiveing | Accumulation |
| At changing | Counting |
| Every t hours | Statistics |
| At KeyOff | Frequency |

Fig.21

| Identification information | Data | Save condition | Calculation condition |
|---|---|---|---|
| 11 | Error extst. | At changing | — |
| 12 | Engine speed [rpm] | Every n times of receiveing | Frequency |
| 13 | Coolant temp. [°C] | Every t hours | Statistics |

Fig.22

First definition file

Corresponding machine type: machine type name M110C

| Identification information | Data | Save condition | Calculation condition |
|---|---|---|---|
| 11 | Error extst. | At changing | — |
| 12 | Engine speed [rpm] | Every n times of receiveing | Frequency |
| 13 | Coolant temp. [°C] | Every t hours | Statistics |

Second definition file

Corresponding machine type: machine type name M135A

| Identification information | Data | Save condition | Calculation condition |
|---|---|---|---|
| 11 | Error extst. | At changing | — |
| 12 | Engine speed [rpm] | Every n times of receiveing | Frequency |
| 13 | Coolant temp. [°C] | Every n times of receiveing | Statistics |

Third definition file

Corresponding machine type: machine type name M100G

| Identification information | Data | Save condition | Calculation condition |
|---|---|---|---|
| 11 | Error extst. | At changing | — |
| 12 | Engine speed [rpm] | Every n times of receiveing | Statistics |
| 13 | Coolant temp. [°C] | Every t hours | Statistics |

Fig.24A
| Machine type name | Definition file | File name |
|---|---|---|
| M110C | First definition file | NB0001 |
| | | NB0001−ver2 |
| M135A | Second definition file | NB0002 |
| M100G | Third definition file | NB0003 |
| ⋮ | ⋮ | ⋮ |
Fig.24B
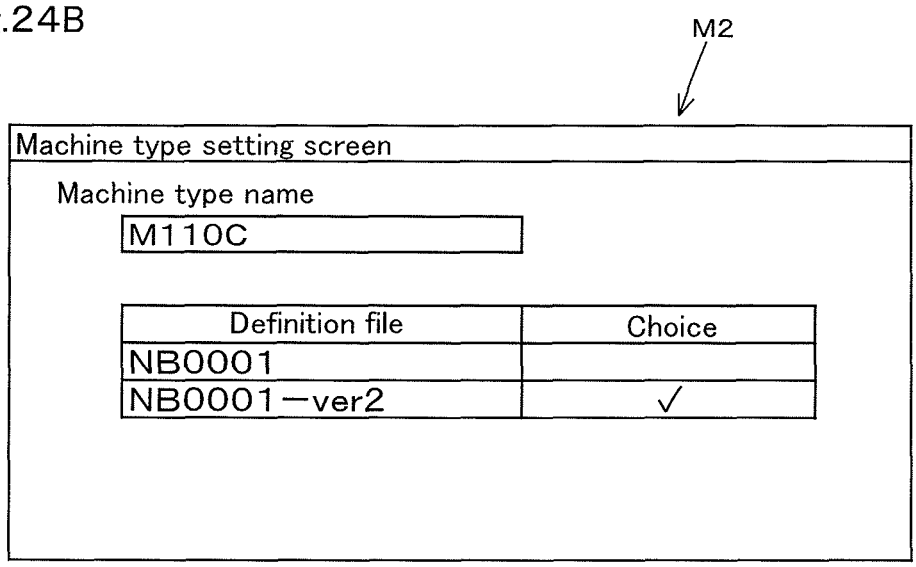
Fig.24C
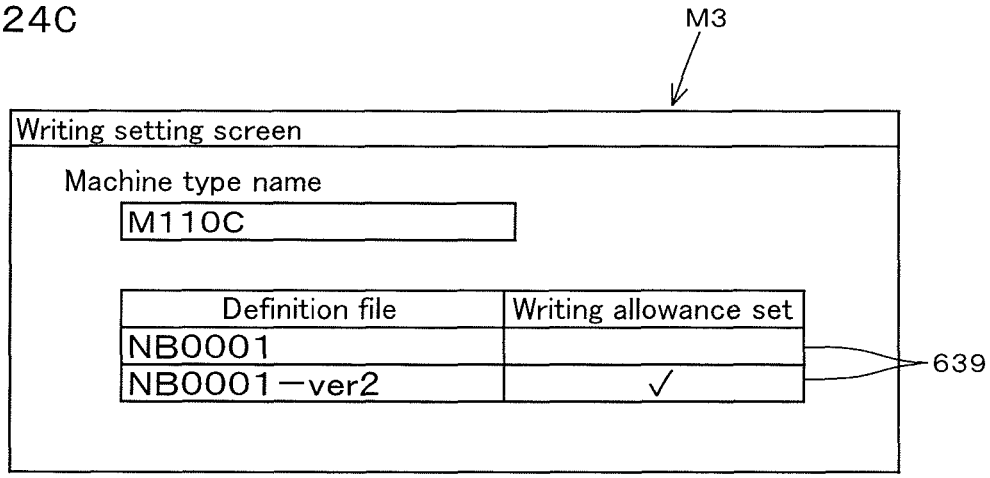

DATA COLLECTION DEVICE, WORKING MACHINE HAVING DATA COLLECTION DEVICE, AND SYSTEM USING DATA COLLECTION DEVICE

TECHNICAL FIELD

The present invention relates to a data collection device for collecting data from a working machine such as an agricultural machine, to the working machine having the data collection device, and to a system using the data collection device.

BACKGROUND ART

Conventionally, a private farmer and a farming group manage an agricultural field, an agricultural operation, an operator (an agricultural operator) for the agricultural operation, and the like. These agricultural managements are usually carried out by using a notebook and the like; however, the agricultural managements increasingly depend on the IT in accordance with development of the information technology. Patent document 1 discloses a data collection system as a technique for carrying out the agricultural managements by using a computer and the like. In addition, Patent document 2 discloses a data communication system as a technique for obtaining information of a working machine.

The data collection system disclosed in Patent document 1 includes: a management terminal having a data recording means and a data display means; and a control device of an agricultural machine, the control device being connected to the management terminal to be capable of communicating with each other. The data collection system is configured to be characterized by sending a conversion factor of sensor information determined for each of the agricultural machines in sending the sensor information from the control device to the management terminal, the sensor information being detected by a sensor of the agricultural machine.

The data communication system disclosed in Patent document 2 is a communication system including: a first controller configured to output control data to a data bus for the CAN communication, the control data being used for controlling a working machine; a second controller configured to control the working machine separately from the first controller; and a third controller configured to be connected to the data bus for the CAN communication. The data communication system is a system configured to intermittently send operation information to the data bus when the data bus shows a free communication state, and to take the operation information by using the third controller.

RELATED ART DOCUMENTS

Patent Documents

[Patent Document 1] Japanese Unexamined Patent Application Publication No. H06-68274.

[Patent Document 2] Japanese Patent Publication No. 5111184.

DISCLOSURE OF THE INVENTION

Problems to be Solved by the Invention

In the data collection system disclosed in Patent document 1, the data collection device (the management terminal) sequentially integrates the number of pulses sent from each of sensors of an agricultural machine. Then, the data collection system converts the integrated number of pulses into a value of each of the sensors by using the conversion factor corresponding to the agricultural machine, and thus collects data of the agricultural machine. Patent document 1 describes that the data collection device can be shared in various types of the agricultural machines.

However, regarding the data collected from the agricultural machine, an amount and the number of types increasingly become large in these years. For this reason, the data collection device has to handle a large amount of and various types of data, and thus it may be hard for a large amount of and various types of data to be handled in a plurality of agricultural machines each using different types of data. In addition to this, regarding a process carried out by the data collection device, the number of processes specialized to a specific agricultural machine is increasing, the data collection device being installed to the specific agricultural machine. For this reason, it is difficult to share one data collection device in the plurality of agricultural machines. In a case where the data collection device is installed to an agricultural machine other than the specific agricultural machine, the data collected by the data collection device installed to the specific agricultural machine are mixed with the data collected by the data collection device installed to an agricultural machine other than the specific agricultural machine, and thus it is very difficult to manage the mixed data.

In the system disclosed in Patent document 2, the third controller is capable of obtaining the operation information of the working machine installing an in-vehicle network (the data bus for the CAN communication). The process of the data after obtained varies depending on a way of obtaining the data in obtaining the various types of data of the working machine such as the operation information of the working machine. Accordingly, it is desired to vary the way of obtaining the data and the like in obtaining the data, considering the process of the data after obtained.

In consideration of the above mentioned problems, the present invention intends to provide a data collection device, a working machine having the data collection device, and a system using the data collection device, the data collection device being capable of appropriately managing data collected by the data collection device. In addition, the present invention intends to provide a data collection device, a working machine having the data collection device, and a system using the data collection device, the data collection device being capable of obtaining a parameter, the parameter being easily handled, in obtaining data (the parameter) of the working machine that installs the in-vehicle network.

Means of Solving the Problems

To achieve the above-mentioned purpose, the present invention provides the following technique.

A data collection device mounted on an agricultural machine having a first identification information being unique, the data collection device being capable of collecting data relating to the agricultural machine, includes: an identification information retaining part configured to retain a second identification information used for identifying the agricultural machine; a check part configured to check the first identification information with the second identification information retained in the identification information retaining part, the first identification information being retained in the agricultural machine; and a data collection processing part configured to carry out, based on a check result by the check part, a process relating to collection of the data.

The data collection device includes: a collection data retention part configured to retain the data collected by the data collection device, wherein the data collection processing part protects the data when the checking of the first identification information with the second identification information is unsuccessful, the data being retained by the collection data retention part.

The data collection processing part stops collecting the data when the checking of the first identification information with the second identification information is unsuccessful.

The data collection processing part notifies an outside that the checking is unsuccessful, when the checking of the first identification information with the second identification information is unsuccessful.

The data collection device includes: a collection data retention part configured to retain the collected data, wherein the data collection processing part retains the check result together with the collected data in the collection data retention part, the check result relating to the first identification information and the second identification information.

The data collection device includes: an hour meter configured to count a total operation time of the agricultural machine, wherein the data collection processing part stops the hour meter when the checking of the first identification information with the second identification information is unsuccessful.

The data collection processing part outputs data to an outside, the data being preliminarily collected before the checking, when the checking of the first identification information with the second identification information is unsuccessful.

The data collection device includes: a display part configured to display that the checking is unsuccessful, when the checking of the first identification information with the second identification information is unsuccessful.

The data collection processing part starts to collect the data when the checking of the first identification information with the second identification information is successful.

The data collection device includes: a collection data retention part configured to retain the collected data; and a communication part configured to receive a request of sending the data, the communication part being configured to send the data retained in the collection data retention part to an outside when receiving the request of sending the data.

An agricultural machine includes: a data collection device mounted on the agricultural machine having a first identification information being unique, the data collection device being capable of collecting data relating to the agricultural machine; a control device configured to control the agricultural machine, wherein the data collection device includes: an identification information retaining part configured to retain a second identification information used for identifying the agricultural machine, and the control device includes: a check part configured to check the first identification information with the second identification information retained in the identification information retaining part, the first identification information being retained in the agricultural machine; and a data collection processing part configured to carry out, based on a check result by the check part, a process relating to collection of the data.

The data collection device includes: a collection data retention part configured to retain the data collected by the data collection device, and the data collection processing part outputs an order to the data collection device, the order ordering protection of the data retained by the collection data retention part, when the checking of the first identification information with the second identification information is unsuccessful.

The data collection processing part outputs an order to the data collection device, the order ordering to stop the collecting of the data, when the checking of the first identification information with the second identification information is unsuccessful.

The data collection device includes: a collection data retention part configured to retain the collected data, and the data collection processing part outputs an order to the data collection device, the order ordering to retain the check result together with the collected data in the collection data retention part, the check result relating to the first identification information and the second identification information.

The agricultural machine includes: an hour meter configured to count a total operation time of the agricultural machine, wherein the data collection processing part stops the hour meter when the checking of the first identification information with the second identification information is unsuccessful.

The control device is configured to retain the first identification information and to output the retained first identification information in response to a request for the first identification information from the check part, the check part requests the first identification information from the control device before the collection of the data.

The data collection processing part outputs an order to the data collection device, the order ordering to start to collect the data when the checking of the first identification information with the second identification information is successful.

The data collection device includes: a collection data retention part configured to retain the collected data; and a communication part configured to receive a request of sending the data, the communication part being configured to send the data retained in the collection data retention part to an outside when receiving the request of sending the data.

A data collection system includes: the data collection device described above; and a mobile terminal configured to be connected to the data collection device and to save data sent from the data collection device, wherein the mobile terminal does not save data sent while the checking of the first identification information with the second identification information is unsuccessful, the data being sent from the data collection device.

A data collection system includes: the data collection device described above; a mobile terminal configured to be connected to the data collection device and to save data sent from the data collection device; and a server configured to be connected to the mobile terminal and to save data sent from the mobile terminal, wherein the server does not save data sent while the checking of the first identification information with the second identification information is unsuccessful, the data being sent from the data collection device.

A data collection system includes: the agricultural machine described above; and a mobile terminal configured to be connected to a data collection device mounted on the agricultural machine and to save data sent from the data collection device, wherein the mobile terminal does not save data sent while the checking of the first identification information with the second identification information is unsuccessful, the data being sent from the data collection device.

A data collection system includes: the agricultural machine described above; a mobile terminal configured to be connected to a data collection device mounted on the agricultural machine and to save data sent from the data collection device; and a server configured to be connected to the mobile terminal and to save data sent from the mobile terminal, wherein the server does not save data sent while the checking of the first identification information with the second identification information is unsuccessful, the data being sent from the data collection device.

A data collection device of a working machine, the data collection device being connected to an in-vehicle network of the working machine and being configured to obtain data outputted to the in-vehicle network, includes: a definition storage part configured to store a data group showing a relation between a group preliminarily determined and data belonging to the group; a first obtaining part configured to obtain, in group units, data belonging to the group shown in the data group; a second obtaining part configured to separate data into individual units, the data of the group units obtained by the first obtaining part, and to obtain the data; and an input-output part configured to output, to the outside, the data of the group units obtained by the first obtaining part; and the data of the individual units obtained by the second obtaining part.

The data collection device includes: an information storage part configured to store obtained data, wherein the definition storage part stores an individual calculation condition where individual data is saved in the information storage part, the individual data being data of the individual units, and the second obtaining part stores, in the information storage part, the individual data obtained by the second obtaining part based on the individual calculation condition.

The data collection device includes: an information storage part configured to store obtained data, wherein the definition storage part stores a group calculation condition showing a condition where a data group is saved in the information storage part, the data group being data of the group units, and the first obtaining part stores, in the information storage part, the data group obtained by the first obtaining part based on the group calculation condition.

The data collection device includes: an information storage part configured to store obtained data, wherein the definition storage part stores a definition file relating first identification information, second identification information, and an individual calculation condition, the first identification information being used for identifying a group, the second identification information being used for identifying individual data that is data of individual units, the individual calculation condition being a condition to save the individual data in the information storage part, the second obtaining part divides the data of the group units into the data of the individual units, extracts the individual calculation condition of the individual data based on: the first identification information of a group including the divided individual data; the second identification information of the individual data; and the definition file, and saves the individual data in the information storage part based on the extracted individual calculation condition.

The data collection device includes: a calculation part configured to calculate the individual data based on the calculation condition shown in the definition file, the definition file having the calculation condition for calculation of the individual data, and the information storage part stores a calculation result of the individual data calculated by the calculation part.

The input-output part outputs the calculation result of the individual data to an outside, the individual data being stored in the information storage part.

A data collection device of a working machine, the data collection device being connected to an in-vehicle network of the working machine and being configured to obtain data outputted to the in-vehicle network, includes: an obtaining part configured to obtain data belonging to a predetermined group in units of the group, and to obtain individual data included in the data obtained in units of the group, the individual data meeting a predetermined calculation condition; and an information storage part configured to save the individual data.

The data collection device includes: a definition file showing, as the calculation condition, a condition where individual data is saved.

The data collection device includes: a calculation part configured to calculate the individual data based on the calculation condition shown in the definition file, the definition file having the calculation condition where the individual data is calculated, wherein the information storage part stores a calculation result of the individual data calculated by the calculation part.

A condition writing system for a data collection device of a working machine, the condition writing system being connected to an in-vehicle network of the working machine and configured to write, to the data collection device, a data group showing a relation between a predetermined group and data belonging to the group; and a calculation condition where the data is save, the data collection device being configured to obtain data outputted to the in-vehicle network, includes: a computer configured to write a definition file including the data group and the calculation condition, corresponding to a type of the working machine having the data collection device, wherein the data collection device obtains, in units of the group, data belonging to the data group included in the definition file, the definition file being written by the computer, and stores individual data included in the data obtained in units of the group, the individual data meeting the calculation condition.

The computer writes the definition file including a calculation condition where the individual data is calculated, corresponding to a type of the working machine, the data collection device includes: a calculation part configured to calculate the individual data based on the calculation condition; and an information storage part configured to store a calculation result of the identification data calculated by the calculation part.

A condition writing system for a data collection device, the condition writing system being configured to write, to the data collection device, a setup condition for collection of data, the data collection device being configured to obtain the data outputted from the working machine, includes: a storage part configured to store a plurality of definition files each having different setup conditions, the different setup conditions being determined for each of the data to be collected; an extraction part configured to extract the definition file corresponding to the working machine from among the plurality of definition files stored in the storage part; and a writing part configured to write the definition file to the data collection device, the definition file being extracted by the extraction part.

The condition writing system includes: a setup change part configured to change the setup condition corresponding to a predetermined data and to store the changed definition file to the storage part, wherein the extraction part extracts the definition file, the definition file corresponding to the working machine and having been changed, from among the plurality of definition files stored in the storage part, and the writing part writes the changed definition file to the data collection device being to be attached to the working machine, the definition file being extracted by the extraction part.

The extraction part extracts the definition file corresponding to a type of the working machine from among the plurality of definition files.

The storage part stores, together with the definition file, information showing whether the definition file can be written.

The setup condition is constituted at least of: a save condition showing contents relating to saving of the data; and a calculation condition showing contents relating to calculation of the data.

Effects of the Invention

According to the present invention, it can be known, by checking the first identification information and the second identification information, whether the data collection device is attached to an agricultural machine preliminarily determined or the data collection device is attached to an agricultural machine other than the agricultural machine preliminarily determined. And, the data collection processing part is capable of changing a process relating the collection of data (for example, a method of data collection, a method of data protection, and the like) on the basis of a check result of: the case where the data collection device is attached to the agricultural machine preliminarily determined (a check between the first identification information and the second identification information is successful); and the case where the data collection device is attached to an agricultural machine other than the agricultural machine preliminarily determined (a check between the first identification information and the second identification information is unsuccessful), and thereby the data collected by the data collection device is managed adequately.

In addition, according to the present invention, the data retained by the collection data retention part can be protected so as not to be erased even in a case where the data collection device is used by being attached to an agricultural machine other than the agricultural machine preliminarily determined.

In addition, according to the present invention, in a case where the data collection device is used by being attached to an agricultural machine other than the agricultural machine preliminarily determined, it is possible to stop the collection of data of an agricultural machine other than the agricultural machine preliminarily determined, thereby preventing the data from being mixed.

In addition, according to the present invention, the data already retained can be protected certainly by detaching the data collection device from the control device and by stopping an operation of the data collection device on the basis of notifying an outside that the data collection device is attached to an agricultural machine other than the agricultural machine preliminarily determined.

In addition, according to the present invention, it is possible to separate: the data (first data) collected by attaching the data collection device to the agricultural machine preliminarily determined; and the data (second data) collected by attaching the data collection device to an agricultural machine other than the agricultural machine preliminarily determined, and thereby the data are separated after the data collection.

In addition, according to the present invention, it is possible to prevent the data collection device from counting the hour meter even in a case where the data collection device is attached to an agricultural machine other than the agricultural machine preliminarily determined, and thereby inconsistency between the hour meter of the data collection device and the data is prevented.

In addition, according to the present invention, it is possible to evacuate the data collected by attaching the data collection device to the agricultural machine preliminarily determined, in a case where the data collection device is attached to an agricultural machine other than the agricultural machine preliminarily determined.

In addition, according to the present invention, an operator can know right beside the data collection device that collection of the operation data is not allowed, and thus can immediately carry out a process of protecting the data already retained.

In addition, according to the present invention, in a case where there are: the data (first data) collected by attaching the data collection device to the agricultural machine preliminarily determined; and the data (second data) collected by attaching the data collection device to an agricultural machine other than the agricultural machine preliminarily determined, it is possible to save only the first data to the mobile terminal.

In addition, according to the present invention, in a case where there are the first data and the second data, it is possible to save only the first data to the server.

In addition, according to the present invention, data outputted to an in-vehicle network can be obtained in units of group preliminarily determined and also can be obtained in individual units. Accordingly, the data after obtained includes: the data obtained in units of group; and the data obtained in individual units. In the data obtained in units of group, a relation between the data can be easily known, for example, and in the data obtained in individual units, the data can be easily analyzed and sorted. That is, the data can have a form easily processed in obtaining the data.

In addition, according to the present invention, individual data having been obtained can be saved under an individual save condition, and thereby necessary individual data is selectively saved from among the individual data having been obtained.

In addition, according to the present invention, the data obtained in units of group (a data group) can be saved under a group save condition, and thereby a necessary data group is selectively saved from among the data group having been obtained.

In addition, according to the present invention, the data group obtained in units of group can be divided into the individual data by using the definition file, and thereby the individual files is saved.

In addition, according to the present invention, a property of the individual data can be obtained by calculating the individual data, and thereby an information amount can be reduced.

In addition, according to the present invention, information relating to the individual data can be known in a small information amount in comparison with a case where the individual data are directly outputted to an outside.

In addition, according to the present invention, data having an identical form can be obtained even in a case where an output condition of data outputted to the in-vehicle network varies depending on a machine type. Furthermore, data outputted to an in-vehicle network can be obtained in units of group preliminarily determined and also can be obtained in individual units, and thereby the data have a form easily processed in obtaining the data.

BRIEF DESCRIPTION OF THE DRAWINGS

FIG. 3 is a view exemplifying work data retained by a collection data retention part of the data collection device;

FIG. 4 is a view showing one example of collection data collected by the data collection device, the data collection device being attached to a tractor;

FIG. 10 is a view showing a parameter group;

FIG. 11 is a view showing a group obtaining table;

FIG. 15 is an explanation view explaining a definition file, the definition file having the individual save condition;

FIG. 16 is an explanation view explaining a definition file, the definition file having the individual save condition and a calculation condition;

FIG. 20 is an explanation view explaining a setting condition;

FIG. 21 is an explanation view explaining a relation between: data; and the save condition and the calculation condition in the definition file;

FIG. 22 is an explanation view explaining a relation between: data; and the save conditions and the calculation conditions in a plurality of the definition files;

FIG. 24A is a view showing a state where a plurality of the definition files are saved, the definition files corresponding to the same machine type;

FIG. 24B is a view showing a machine type setup screen where a plurality of the definition files are chosen; and FIG. 24C is a view showing a writing setup screen.

BEST MODE FOR CARRYING OUT THE INVENTION

Referring to drawings, a data collection device according to embodiments of the present invention will be explained below, and a data collection system using the data collection device also will be explained below.

First Embodiment

Figure 1:
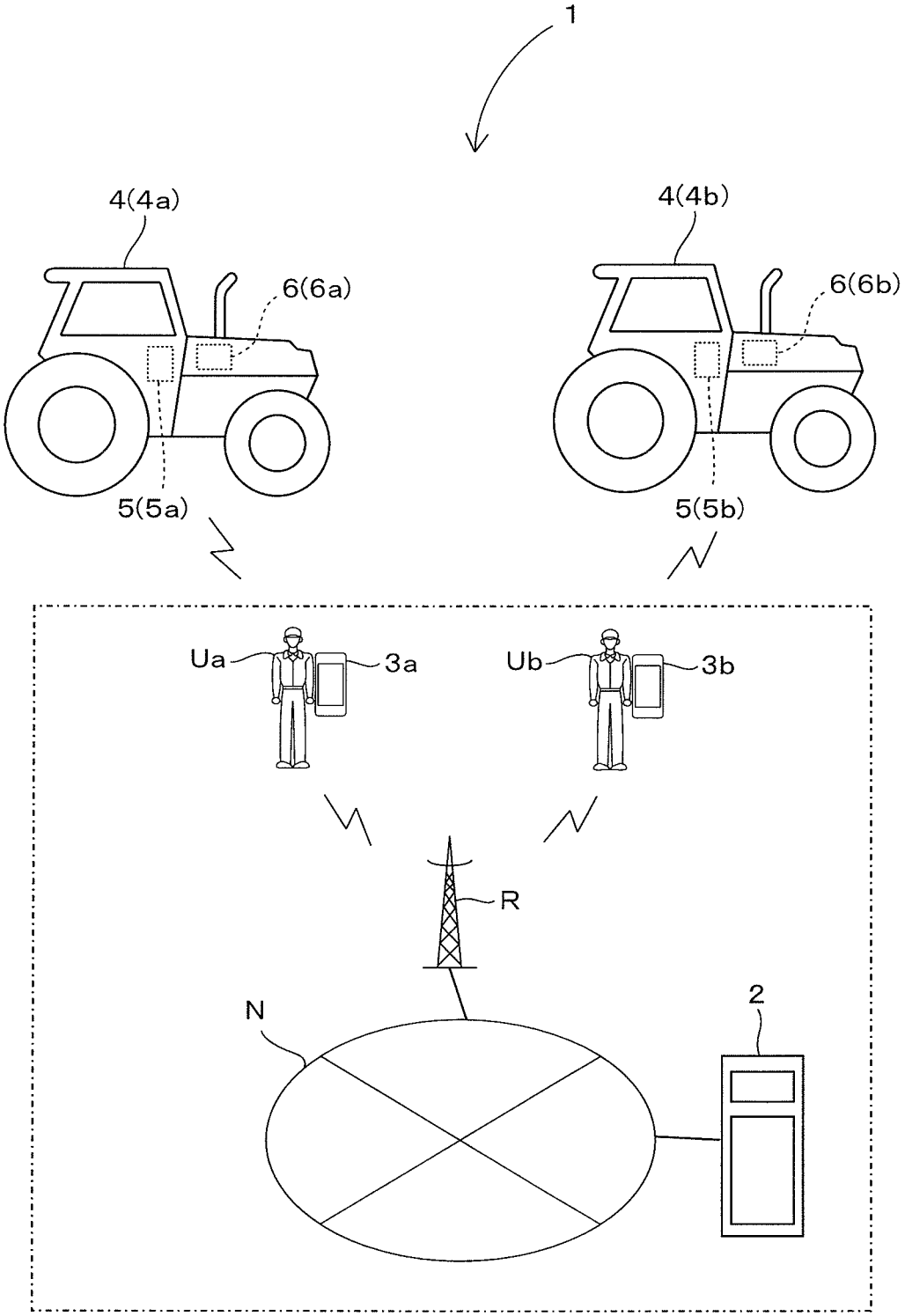
FIG. 1 is a view showing a schematic configuration of a data collection system according to embodiments of the present invention.

Referring to FIG. 1, a schematic configuration of a data collection system 1 according to the embodiment will be explained. FIG. 1 is a view showing a schematic configuration of the data collection system 1 according to the embodiment.

The data collection system 1 includes: an agricultural machine 4 having a control device 6 described later; a data collection device 5; a mobile terminal 3; and a server 2. The data collection device 5 is attached to the agricultural machine 4, and is connected to the control device 6 by a vehicle communication network. The mobile terminal 3 communicates with the data collection device 5 in wireless. The server 2 is capable of being connected to the mobile terminal 3 through a wireless communication and a network line. Meanwhile, the agricultural machine 4 is a machine such as a tractor. combine, and a rice transplanter, the machine being configured to carry out an agricultural operation.

FIG. 1 shows, as the data collection system 1, two tractors 4 (4*a* and 4*b*) that are the agricultural machines 4; two mobile terminals 3 (3*a* and 3*b*); the server 2 connected to a network N; and a relay station R configured to connect the mobile terminals 3*a* and 3*b* to the network N. In the data collection system 1 shown in FIG. 1, the tractor 4*a* includes the control device 6 (6*a*). The data collection device 5 (5*a*) is connected to the control device 6*a*. The mobile terminal 3*a* corresponds to the tractor 4*a* and the control device 6*a*. In addition, the tractor 4*b* includes the control device 6 (6*b*). The data collection device 5 (5*b*) is connected to the control device 6*b*. The mobile terminal 3*b* corresponds to the tractor 4*b* and the control device 6*b*.

In the data collection system 1, the data collection device 5*a* collects various data as operation data from the control device 6*a* of the tractor 4*a*, the various data being obtained by an operation of the tractor 4*a*, and retains the operation data. The data collection device 5*a* outputs (sends) retained operation data to the mobile terminal 3*a* in response to a request from the mobile terminal 3*a*. The mobile terminal 3*a* receives the operation data from the data collection device 5*a*, and outputs (sends) received operation data to the server 2 through the relay station R and the network N. The server 2 receives the operation data sent from the mobile terminal 3*a* and accumulates the operation data.

In the same manner, the data collection device 5*b* collects various data as operation data from the control device 6*b* of the tractor 4*b*, the various data being obtained by an operation of the tractor 4*b*, and retains the operation data. The data collection device 5*b* outputs (sends) retained operation data to the mobile terminal 3*b* in response to a request from the mobile terminal 3*b*. The mobile terminal 3*b* receives the operation data from the data collection device 5*b*, and outputs (sends) received operation data to the server 2 through the relay station R and the network N. The server 2 receives the operation data sent from the mobile terminal 3*b* and accumulates the operation data.

Figure 2:
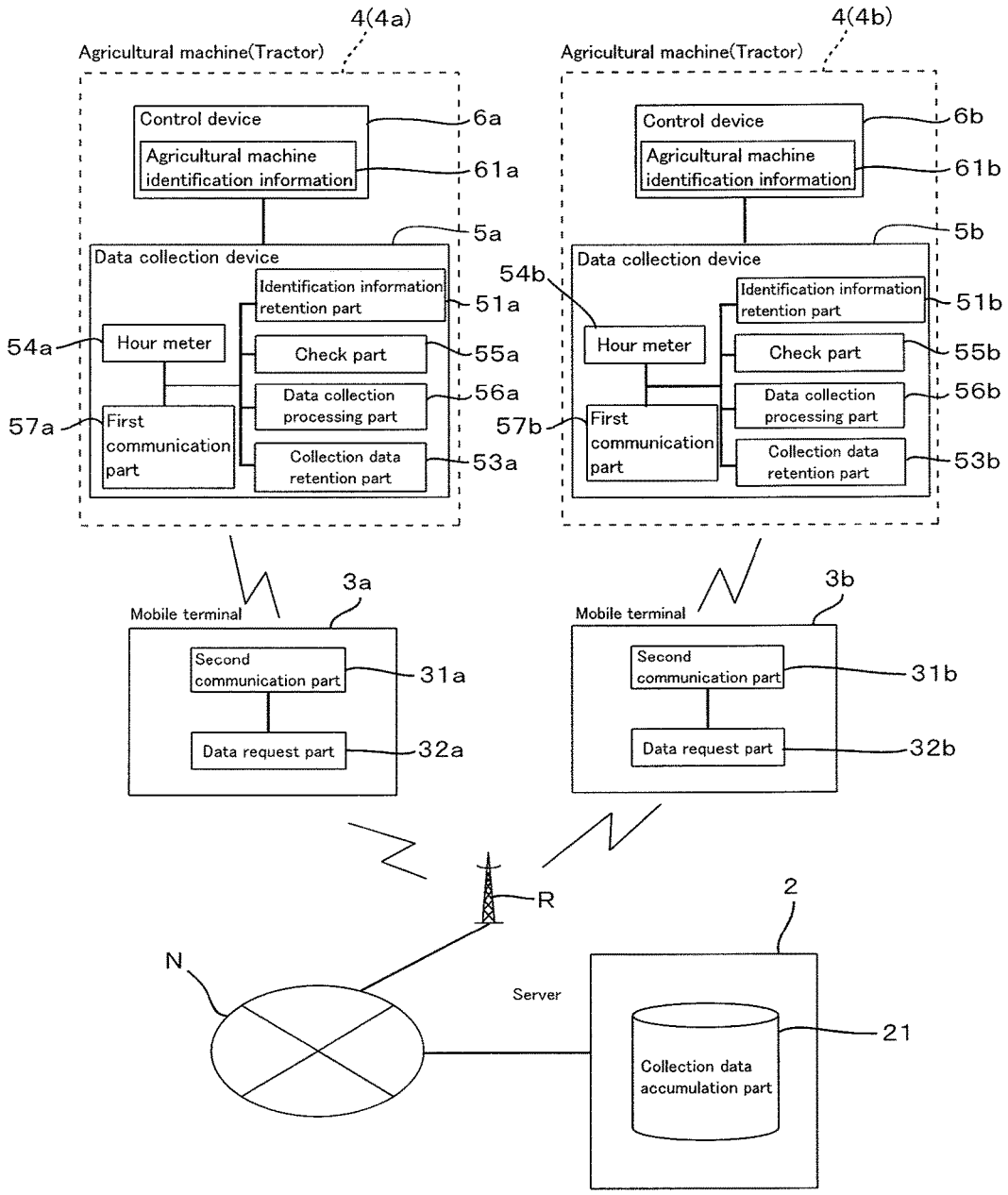
FIG. 2 is a view showing in detail a configuration of the data collection system according to a first embodiment.

Referring to FIG. 2 to FIG. 4, details of the data collection system 1 having the above-described schematic configuration will be explained. FIG. 2 is a view showing in detail a configuration of the data collection system 1 shown in FIG. 1. FIG. 3 is a view showing an example of collection data. FIG. 4 is a view showing one example of the collection data collected by the data collection device 5*b*, the data collection device 5*b* being attached to the tractor 4*a*.

Figure 8:
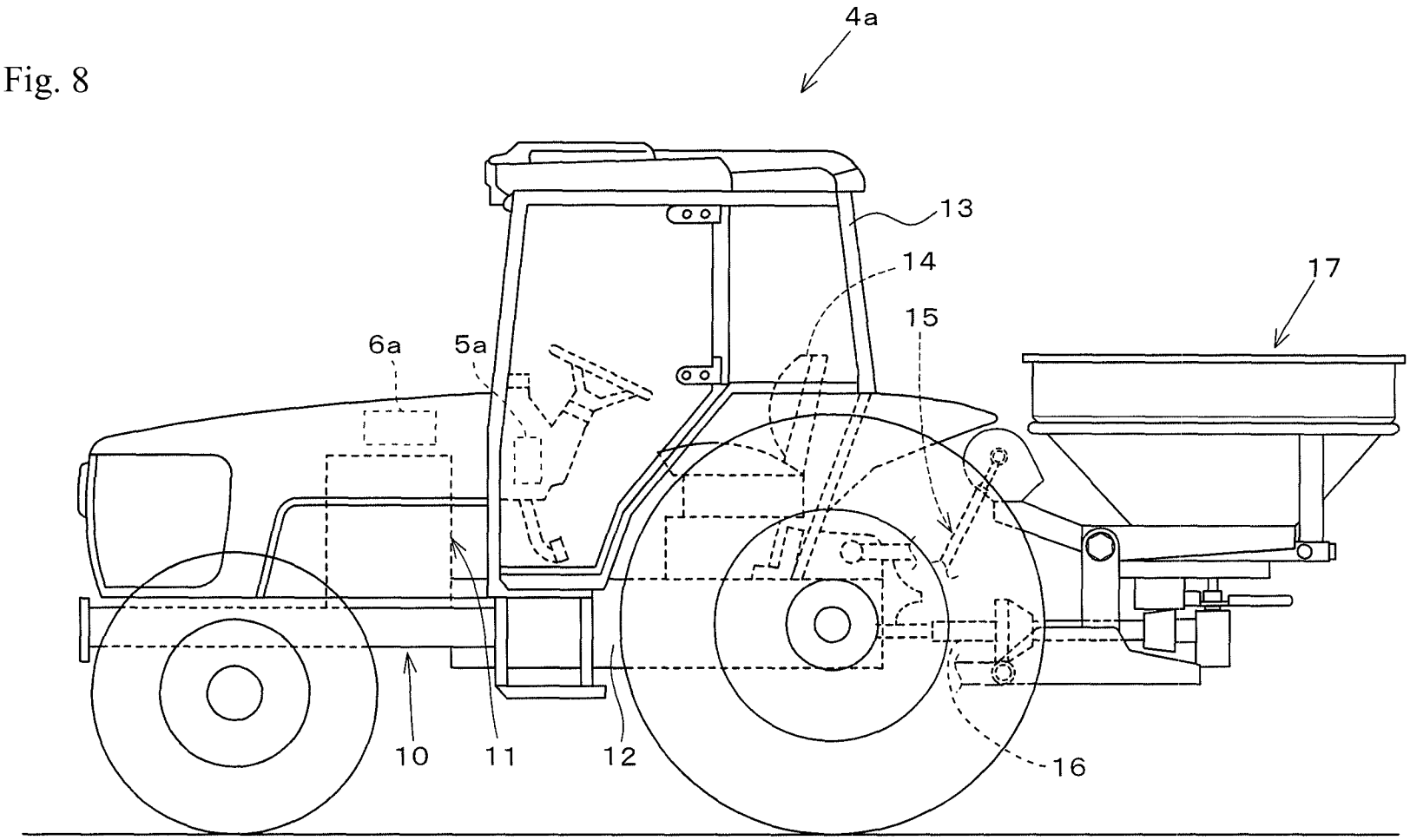
FIG. 8 is a schematic view showing an overall configuration of the tractor.

Referring to FIG. 2 and FIG. 8, details of the tractors 4*a* and 4*b* constituting the data collection system 1 will be explained. Since the tractor 4*a* and the tractor 4*b* have approximately identical configuration, the tractor 4*a* will be explained here. FIG. 8 is a schematic view showing an overall configuration of the tractor 4*a*.

As shown in FIG. 8, the tractor 4*a* is configured by mounting an engine 11, a transmission gear box 12, and the like on a travel vehicle (travel body) 10 provided with wheels at a front and of and a rear end of the travel vehicle 10. A standalone cabin 13 is disposed in rear of the engine 11, and an operator seat 14 is disposed in the cabin 13.

In addition, a three-point link mechanism 15 is disposed on the rear portion of the travel vehicle 10, the three-point link mechanism 15 being configured to be freely movable upward and downward, and a PTO shaft 16 is disposed on the rear portion of the travel vehicle 10, the PTO shaft 16 being configured to transmit a motive power from the engine 11. An operation tool (an implement) such as a fertilizer distributor 17, a cultivator, an agricultural chemicals distributor, a seed distributor, or a harvest machine can be freely attached to and detached from the three-point link mechanism 15. In the embodiment, as shown in FIG. 8, the fertilizer distributor 17 is attached to the three-point link mechanism 15. The fertilizer distributor 17 is attached also to the PTO shaft 16. The fertilizer distributor 17 is moved by a motive power generated by revolution of the PTO shaft 16, thereby distributing a fertilizer (a fertilizer distribution).

As shown in FIG. 1 and FIG. 2, the tractor 4*a* having the above described configuration includes the control device 6*a*, the control device 6*a* being configured to control a travel system, an operation system, and the like of the tractor 4*a*. For example, the control device 6*a* is constituted of a microcontroller such as a main ECU serving as an electronic control unit. The control unit 6*a* controls as the control of the travel system: an operation of the engine 11; and the traveling such as a vehicle speed. The control unit 6*a* controls as the control of the operation system: elevation of the three-point link mechanism 15; and an output (a revolution speed) adjustment of the PTO shaft 16. When receiving an input from an operation tool disposed around the operator seat 14, for example, from an operation lever and an operation switch, the control device 6*a* carries out the control of the operation system in accordance with the input value.

Control signals and various types of detection signals (for example, a signal detected by a sensor) is outputted from the control device 6*a* and various types of sensors to the vehicle communication network (for example, the Controller Area Network, the FlexRay, and the like), the control signals being used for the travel system control of and the operation system control of the tractor 4*a*, the various types of detection signal being used for the controls, and is transmitted to each of sections of the tractor 4*a*. Meanwhile, the above described travel system control and the above described operation system control by the control device 6*a* are just examples, and thus are not limited to the above described configuration.

Furthermore, an operation panel is disposed on the fertilizer distributor 17, the operation panel being configured to control an operation of the fertilizer distributor 17. An operator operates switches of the operation panel, there by variously changing a setup configuration relating to the operation of the fertilizer distributor 17. Regarding the fertilizer distributor 17 attached to the three-point link mechanism 15, a setup configuration, for example, a type of and a distribution amount of fertilizer can be changed by the operation panel.

A distribution amount (for example, kilograms) of fertilizer per unit area (for example, 10 are) is set as the distribution amount of fertilizer. The fertilizer distributor 17 controls the distribution amount of fertilizer in accordance with a vehicle speed of the tractor 4*a* under a control by the operation panel, and carries out the fertilizer distribution to distribute the fertilizer in accordance with the setup value in the operation panel.

The operation panel is connected to the above described vehicle communication network. The type of and the distribution amount of the fertilizer each being set by the operation panel are outputted to the vehicle communication network. In addition, the operation panel receives the vehicle speed and the like of the tractor 4*a*, the vehicle speed and the like being outputted to the vehicle communication network by the control device 6*a*.

Meanwhile, a signal for the control, a control signal is sent and received in wired or in wireless between the fertilizer distribution device 17 and the operation panel, the control signal being used for controlling the fertilizer distributor 17. In addition, the operation panel may be disposed near the fertilizer distributor 17, and may be disposed near the operator set 14 in the cabin.

In a case where the fertilizer distributor 17, the agricultural chemicals distributor, and the seed distributor are employed as the operation tool (the implement), the vehicle speed and the revolution speed of engine are outputted as the operation data on the vehicle communication network from the control device 6*a*. In addition, in a case where the fertilizer distributor 17, the agricultural chemicals distributor, and the seed distributor are employed as the operation tool (the implement), the distribution amount (the fertilizer distribution amount, the agricultural chemicals distribution amount, and the seed distribution amount) are also outputted as the operation data on the vehicle communication network from the operation tool.

In a case where the harvest machine is employed as the operation tool, the operation data, for example, the vehicle speed and the revolution speed of engine are outputted from the control device 6*a* on the vehicle communication network, and further the operation data, for example, a harvest amount is outputted from the harvest machine on the vehicle communication network.

The configuration of the control device 6*a* described above will be explained more.

As shown in FIG. 2, the control device 6*a* has agricultural machine identification information (first identification information) 61*a*, the agricultural machine identification information serving as information unique to the control device 6*a* or to the tractor 4*a* having the control device 6*a*. The agricultural machine identification information is information enabling the control device 6*a* and the tractor 4*a* to be identified, for example, a serial number such as a production number of the control device 6*a* or the tractor 4*a*. Referring to the agricultural machine identification information included in the control device 6*a*, the tractor 4*a* can be identified from among the plurality of agricultural machines. The tractor 4*b* and the control device 6*b* each have agricultural machine identification information (first identification information) 61*b*, the agricultural machine identification information enabling the control device 6*b* and the tractor 4*b* to be identified.

Next, referring to FIG. 2, a configuration of the data collection device 5*a* will be explained in detail, the data collection device 5*a* being attached to the tractor 4*a*. Meanwhile, the data collection device 5*b* has a configuration approximately identical to the data collection device 5*a*, and accordingly an explanation of the data collection device 5*b* will be omitted.

The data collection device 5*a* is disposed on the tractor 4*a*. The data collection device 5*a* is capable of automatically collecting various data (the operation data) through the vehicle communication network, the various data relating to an agricultural operation carried out by an operation of the tractor 4*a*.

As shown in FIG. 8, the fertilizer distributor 17 is jointed to a rear portion of the tractor 4*a*. For this reason, the data, for example, the vehicle speed, the revolution speed of engine, the distribution amount (the fertilizer distribution amount, the agricultural chemicals distribution amount, and the seed distribution amount) are outputted as the operation data to the vehicle communication network when the tractor 4*a* is operated.

In addition, as another example, the operation data, for example, the revolution speed of rotary, a load of rotary, the revolution speed of engine, the vehicle speed, and a depth of plowing are outputted to the vehicle communication network in a case where the cultivator is jointed to the rear portion of the tractor 4*a*. Moreover, the operation data, for example, the harvest amount is outputted, in addition to the vehicle speed and the revolution speed of engine, to the vehicle communication network in a case where the harvest machine is jointed to the rear portion of the tractor 4*a*. The data collection device 5*a* collects the above described operation data outputted to the vehicle communication network, and retains the operation data.

The data collection device 5*a* operating in the above described manner includes an identification information retention part 51*a*, a check part 55*a*, a data collection processing part 56*a*, a collection data retention part 53*a*, an hour meter 54*a*, and a first communication part 57*a*.

The identification information retention part 51*a* retains second identification information used for identifying the tractor 4*a* that is an agricultural machine. The check part 55*a* checks the first identification information and the second identification information with each other, the first identification information being retained in the tractor 4*a*, the second identification information being retained in the identification information retention part 51*a*. The data collection processing part 56*a* carries out a process relating to collection of the data (the operation data) on the basis of a result of the checking in the check part 55*a*. The collection data retention part 53*a* retains collected operation data. The hour meter 54*a* counts a total operation time of the data collection device 5*a*. The first communication part 57*a* communicates with the mobile terminal 3*a* in wireless.

In particular, the identification information retention part 51*a* retains, as the second identification information, information related to the agricultural machine identification information 61*a*, the agricultural machine identification information 61*a* being the first identification information retained in the control device 6*a* of the tractor 4*a*. The second identification information may be information capable of introducing or specifying the agricultural machine identification information 61*a* by being calculated, and may be the agricultural machine identification information 61*a* itself.

The second identification information may be preliminarily retained in the identification information retention part 51*a* before the data collection device 5*a* is firstly connected to the control device 6*a*, and may be generated on the basis of the first identification information (the agricultural machine identification information 61*a*) when the data collection device 5*a* is connected to the control device 6*a*, the first identification information being retained in the control device 6*a* of the tractor 4*a*.

The check part 55*a* checks the agricultural machine identification information 61*a* with the second identification information, the agricultural machine identification information 61*a* being the first identification information retained in the control device 6*a* of the tractor 4*a*, the second identification information being retained in the identification information retention part 51*a*.

In particular, the check part 55*a* obtains the agricultural machine identification information 61*a* from the control part 6*a*, the agricultural machine identification information 61*a* being the first identification information, obtains the second identification information from the identification information retention part 51*a*, and then checks (compares) the second identification information with the agricultural machine identification information 61*a*. In the comparison, it can be judged whether the second identification information corresponds to the agricultural machine identification information 61*a*, for example, whether the second identification information is related to the agricultural machine identification information 61*a*, or whether the second identification information is identical to the agricultural machine identification information 61*a*.

The data collection processing part 56*a* starts to collect the operation data as a process relating to the collection of data, the operation data flowing on the vehicle communication network, when the second identification information is information corresponding to the agricultural machine identification information 61*a*, that is, when the checking for both of the first identification information and the second identification information is successful. On the other hand, the data collection processing part 56*a* carries out a process in unsuccessful check (an unsuccess process) described below, when the second identification information is information not corresponding to the agricultural machine identification information 61*a*, that is, when the checking for both of the first identification information and the second identification information is unsuccessful.

The hour meter 54*a* counts a total operation time of the tractor 4*a*, and the total operation time is shown by using hours, minutes, and seconds, for example. In the explanation described below, the total operation time shown by the hour meter 54*a* is referred to as an hour meter.

The collection data retention part 53*a* sequentially retains the operation data collected by the data collection device 5*a* from the control device 6*a*, adds the hour meter of the collection to the operation data, and then retains the operation data with the hour meter.

The first communication part 57*a* communicates with the mobile terminal 3*a* described below in wireless, and is constituted of a device for a short range wireless. communication. The first communication part 57*a* carries out the communication in wireless, for example, in the Wi-Fi (Wireless Fidelity, registered trademark) of the IEEE802.11 series that is a communication standard.

The data collection device 5*a* outputs (sends) the operation data to the mobile terminal 3*a* described below through the first communication part 57*a*, the operation data being retained in the collection data retention part 53*a*.

Operations of the identification information retention part 54*a*, a data collection judgement part 52*a*, the collection data retention part 53*a*, the hour meter 54*a*, and the first communication part 57*a* are controlled by a control part (not shown in the drawings) for controlling whole of operations of the data collection device 5*a*.

Meanwhile, each of components constituting the data collection device 5*a* described above is constituted of a processing unit such as a CPU (Central Processing Unit), an MPU (Micro Processing Unit), and the like or of an electronic device such as a storage device, for example, a memory, and is operated by a computer program.

The mobile terminal 3*a* is constituted, for example, of a smartphone (multifunctional mobile phone) or a mobile computer such as a tablet PC, which has a relatively high computing capability. The mobile terminal 3*a* has a configuration approximately identical to the first communication part 57*a* of the data collection device 5*a*, and includes: a second communication part 31*a* configured to communicate with the first communication part 57*a* in wireless; and a data request part 32*a* configured to request the operation data thorough the second communication part 31*a*, the operation data being retained in the data retention part 53*a* of the data collection device 5*a*.

The mobile terminal 3*b* has a configuration approximately identical to the mobile terminal 3*a*, and accordingly an explanation of the mobile terminal 3*b* will be omitted.

The second communication part 31*a* communicates with the data collection device 5*a* and the server 2 in wireless, and is constituted of a communication device. The second communication part 31*a* communicates with the data collection device 5*a* in wireless, for example, in the Wi-Fi (Wireless Fidelity, registered trademark) of the IEEE802.11 series that is a communication standard. In addition, the second communication part 31*a* communicates with the server 2 in wireless, for example, in a data communication network or in a mobile phone communication network. Meanwhile, the relay station R is a base station of the mobile phone communication network, and the second communication part 31*a* includes two communication means, a short range wireless communication and a mobile phone communication.

The data request part 32*a* outputs a data request signal to the data collection device 5*a*, the data request signal requesting the operation data retained in the collection data retention part 53*a*, under a certain condition such as an operation by an operator Ua carrying the mobile terminal 3*a*.

The data request signal outputted from the data request part 32*a* is sent to the data collection device 5*a* through the second communication part 31*a*.

The mobile terminal 3*a* having the above described configuration sends the operation data thorough the second communication part 31*a* to the server 2 being connected to a network N, the operation data being obtained from the collection data retention part 53*a* of the data collection device 5*a*.

The server 2 includes a collection data accumulation part 21, the collection data accumulation part 21 being configured to receive and accumulate the operation data sent from the mobile terminal 3*a*. The server 2 accumulates the operation data of the data collection device 5*a* to the collection data accumulation part 21. In addition, the server 2 also accumulates the operation data of the data collection device 5*b* to the collection data accumulation part 21. In this manner, the operation data of the tractors 4*a* and 4*b* are accumulated to the server 2, and thereby the operation data is analyzed and evaluated in the server 2.

Referring to FIG. 3, the operation data of the tractor 4*a* will be explained, the operation data having been collected from the tractor 4*a* and accumulated in the collection data retention part 53*a*. A list shown by an arrowed line 90 of FIG. 3 shows the operation data accumulated in the collection data retention part 53*a*. A list shown by an arrowed line 91 of FIG. 3 shows the operation data accumulated in the collection data retention part 53*b*.

In the collection data retention part 53*a*, the operation data is accumulated in a form shown by the list, the list being shown by the arrowed line 90 in FIG. 3. For example, the collection data retention part 53*a* accumulates data relating the operation data and the identical hour meter to each other, the operation data being a vehicle speed, a revolution speed of PTO, a fertilizer distribution amount, and the like. Meanwhile, the operation data may be accumulated in an ascending order of or a descending order of the hour meter in the collection data retention part 53*a*.

The list shown by the arrowed line 90 in FIG. 3 shows a collection data group 210 and a collection data group 211, the collection data group 210 being a series of the operation data having values of the hour meters, "13 hours 20 minutes 00 seconds (13:20:00)" to "13 hours 32 minutes 59 seconds (13:32:59)", the collection data group 211 being a series of the operation data having values of the hour meters, "13 hours 45 minutes 18 seconds (13:45:18)" to "13 hours 53 minutes 26 seconds (13:53:26)". Not shown in the drawings, the collection data group having the hour meters smaller than those of the collection data group 210 are also accumulated in the collection data retention part 53*a*.

Here, the operation data lastly accumulated in the collection data retention part 53*a*, that is, the collection data group 211 shows the hour meter indicating 13-plus hours, the vehicle speed indicating about 1.50 km/h, the revolution speed of PTO indicating about 320 rpm, and the fertilizer distribution amount indicating 0.08 to 0.09 kg.

As shown in the list shown by the arrowed line 91 in FIG. 3, the operation data collected from the tractor 4*b* are also accumulated as the collection data group 220 and the collection data group 221 in the collection data retention part 53*b*. Not shown in the drawings, the collection data group having the hour meters smaller than those of the collection data group 220 are also accumulated in the collection data retention part 53*b*.

Here, the operation data lastly accumulated in the collection data retention part 53*b*, that is, the collection data group 221 shows the hour meter indicating 98 to 99-plus hours, the vehicle speed indicating about 1.80 km/h, the revolution speed of PTO indicating about 350 rpm, and the fertilizer distribution amount indicating 0.04 to 0.05 kg, and accordingly has a trend different from that of the collection data group 211 of the collection data retention part 53*a*.

According to the data collection system 1 having the above described configuration, the operation data of the tractor 4*a* are surely saved in the collection data retention part 53*a*, and the operation data of the tractor 4*b* are surely saved in the collection data retention part 53*b*. Here, in a case where the data collection device 5*b* attached to the tractor 4*b* is detached and then is attached to the tractor 4*a*, the operation data of the tractor 4*b* and the operation data of the tractor 4*a* are mixed with each other, and thereby the management of the operation data becomes complex.

FIG. 4 shows one example of the collection data of a case where the data collection device 5*b* previously attached to the tractor 4*b* is attached to the tractor 4*a*.

The collection data group 220 and the collection data group 221 each shown in FIG. 4 are the operation data relating to the tractor 4*b*, the operation data being shown by the arrowed line 91 in FIG. 3, and the collection data group 230 shown in FIG. 4 are the operation data relating to the tractor 4*a*.

As shown in FIG. 4, in the collection data group 230, the operation data show the vehicle speed indicating about 1.50 km/h, the revolution speed of PTO indicating about 320 rpm, and the fertilizer distribution amount indicating 0.08 to 0.09 kg, and thus indicate values relating to the tractor 4*a*. These data (values) have to be related to the hour meter corresponding to the data collection device 5*a*, for example, to be related to the hour meter of 13-plus hours; however, these data will be related to the hour meter corresponding to the data collection device 5*b*, for example, to be related to the hour meter continuing to 98 to 99-plus hours. That is, in the data collection device 5*b*, the collection data group 230 relating to the tractor 4*a*, the collection data group 230 corresponding to the hour meter of 99-plus hours, are accumulated continuing to the collection data group 221 relating to the tractor 4*b*, the collection data group 221 corresponding to the hour meter of 99-plus hours, and thus it becomes complex to manage the operation data of the tractor 4*b* and the tractor.

In this manner, since the management of the operation data is complex in a case where the data collection devices 5*a* and 5*b* are attached to non-corresponding one of the tractors 4*a* and 4*b*, firstly in the present invention, the first identification information is retained on a side of the tractor 4*a* (4*b*), the second identification information is retained on a side of the data collection device 5*a* (5*b*), and then the check part 55*a* (55*b*) carries out the checking for both of the first identification information and the second identification information in collecting the data; thereby, it is judged whether the data collection device 5 is replaced. Then, when it is determined that the data collection device 5 has been replaced, that is, when the checking for both of the first identification information and the second identification information is unsuccessful, the data collection processing part 56*a* (56*b*) carries out the unsuccess process described as follows.

As described above, in a case where the data collection device 5*a* is attached to the tractor 4*a*, and in a case where the data collection device 5*b* is attached to the tractor 4*b*, the checking will be successful, and thus the unsuccess process is not carries out. On the other hand, in a case where the data collection device 5*b* is attached to the tractor 4*a*, and in a case where the data collection device 5*a* is attached to the tractor 4*b*, the checking will be unsuccessful, and thus the unsuccess process is carries out.

Next, exemplifying the case where the data collection device 5*b* is attached to the tractor 4*a*, the unsuccess process of the data collection device 5*b* (the data collection processing part 56*b*) will be explained, the unsuccess process being carried out when the checking for both of the first identification information and the second identification information is unsuccessful. Meanwhile, an operation of the unsuccess process of the data collection device 5*a* (the data collection processing part 56*a*) is approximately identical to that of the data collection device 5*b* (the data collection processing part 56*b*), and accordingly an explanation of the unsuccess process of the data collection device 5*b* (the data collection processing part 56*b*) will be omitted.

The unsuccess process carried out by the data collection processing part 56*b* includes a plurality of processes, a first process to a seventh process.

In a primary process (the first process), writing of the operation data to the collection data retention part 53*b* is forbidden to protect the operation data already retained. For example, the data collection processing part 56*b* forbids the collection data retention part 53*b* from writing the collection data group 230.

In a secondary process (the second process), the operation data already stored in the collection data retention part 53*b* (the operation data at the successful checking) is protected so as not to be lost by being overwritten. For example, the data collection processing part 56*b* protects the collection data groups 220 and 221 so that the operation data of the collection data groups 220 and 221 are not erased by overwriting of and saving of the collection data group 230 newly collected. For example, the data collection processing part 56*b* saves the collection data group 230 and the collection data groups 220 and 221 separately in the collection data retention part 53*b*, and disenables the data regions of the collection data groups 220 and 221 to be overwritten.

In a tertiary process (the third process), the data already stored in the collection data retention part 53*b* (the operation data at the successful checking) is outputted to an outside such as the server 3 and the mobile terminals 3*a* and 3*b* to evacuate the operation data already stored. For example, the data collection processing part 56*b* sends the operation data of the collection data groups 220 and 221 to the server 2 and the mobile terminals 3*a* and 3*b*, the operation data being already stored in the collection data retention part 53*b*. At that time, the data collection device 5*b* sends the first identification information (the agricultural machine identification information 61*b*) of the tractor 4*b* or the second identification information of the data collection device 5*b* together with the collection data groups 220 and 221, the data collection device 5*b* being attached to the tractor 4*b*, and thus the server 2 can recognize that the collection data groups 220 and 221 corresponding to the tractor 4*b* or the data collection device 5*b*.

In a quaternary process (the fourth process), the collecting of the operation data by the data collection device 5*b* is stopped after the checking for both the first identification information and the second identification information is unsuccessful. For example, the data collection processing part 56*b* does not carry out the collecting of the collection data group 230 after the checking for both the first identification information and the second identification information is unsuccessful.

In a quinary process (the fifth process), the data collection device 5*b* continues to collect the operation data after the checking for both the first identification information and the second identification information is unsuccessful; and additionally the result of the checking for both of the first identification information and the second identification information is related to the operation data, and the operation data and the result of the checking are retained in the collection data retention part 53*b*. For example, the data collection processing part 56*b* adds an unsucess flag F to the collection data group 230 collected after the checking is unsuccessful, the unsucess flag F indicating that the checking for both the first identification information and the second identification information is unsuccessful, and saves the unsuccess flag F and the collection data group 230 to the collection data retention part 53*b*.

In a senary process (the sixth process), the outsides such as the server 2 and the mobile terminals 3*a* and 3*b* are notified of the unsucess of the checking for both of the first identification information and the second identification information. For example, when the checking for both the first identification information and the second identification information is unsuccessful, the data collection processing part 56*b* sends the unsuccessful checking to the mobile terminal 3*b*, and displays the unsuccessful checking on the mobile terminal 3*b*. On the basis of the notification, the data already retained in the collection data retention part 53*b* can be surely protected in a manner, for example, disconnecting the data collection device 5*b* from the control device 6*b*, or stopping the operation of the data collection device 5*b*.

Figure 7:
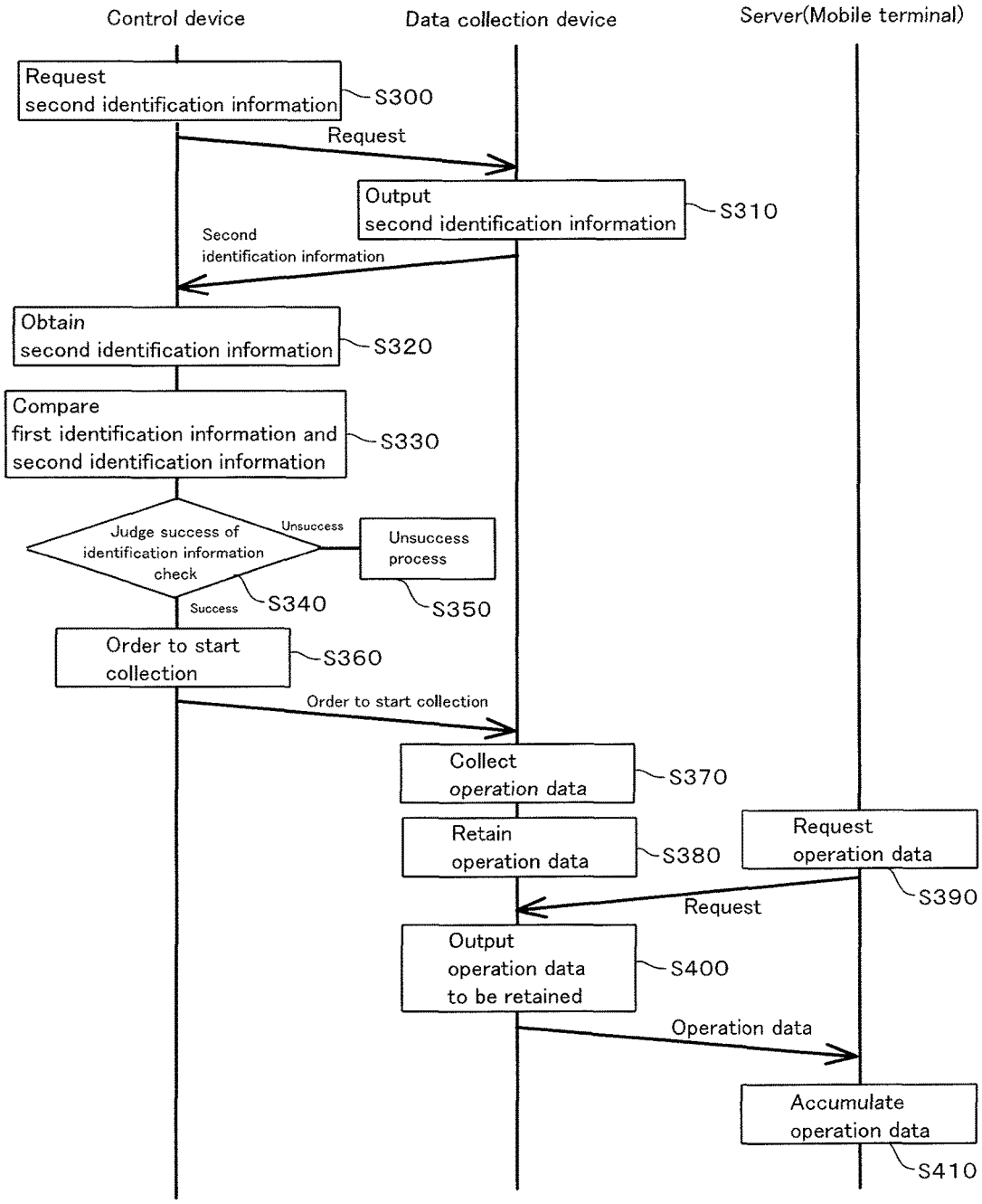
FIG. 7 is a view showing an operation of the data collection system according to the second embodiment.

In a septenary process (the seventh process), the hour meter of the data collection device 5*b* is stopped. For example, as shown in FIG. 7, in a case where the hour meter of the data collection device 5*b* shows "99 hours 03 minutes 16 seconds (99:03:16)" immediately before the checking becomes unsuccessful, a counting process of the hour meter is stopped after the "99 hours 03 minutes 16 seconds" when the checking becomes unsuccessful. In this manner, the hour meter of the data collection device 5*b* is stopped, and thereby being prevented from counting even when the data collection device 5*b* different from the data collection device 5*a* is attached to the tractor 4*a*, and thus non-correspondence between the data and the hour meter of the data collection device 5*b* can be prevented.

Meanwhile, the data collection processing part 56*b* carries out any one of the first process to the seventh process described above at the unsuccess process; however, the data collection processing part 56*b* may carry out the first process to the seventh process in combination.

For example, the data collection processing part 56*b* may carry out: the first process for forbidding to write the operation data to the collection data retention part 53*b* after the checking becomes unsuccessful; and the third process for outputting the operation data to the outside such as the server 3 and the mobile terminals 3*a* and 3*b*, the operation data being saved in the collection data retention part 53*b* before the checking becomes unsuccessful. In addition, the data collection processing part 56*b* may carry out: the second process for disenabling to overwrite the operation data, the operation data being collected before the checking becomes unsuccessful; and the sixth process to notify the server 2 and the like of the unsucess of the checking for both of the first identification information and the second identification information. In addition, the data collection processing part 56*b* may carry out: the second process; and the third process for stopping the collection of the operation data.

Meanwhile, in order to notify the outside of the unsucess of the checking for both of the first identification information and the second identification information, a method described below may be employed, the method including: disposing a display part (not shown in the drawings) on the data collection device 5*a*, the display part being constituted of LEDs (Light emitting devices) and the like; and lighting the display part. When the display part is disposed on the data collection device 5*a*, it can be known just beside the data collection device 5*a* that the checking for both of the first identification information and the second identification information is unsuccessful, and thereby rapidly promote to carry out the process for protecting the data already stored in the collection data retention part 53*a*.

Figure 5:
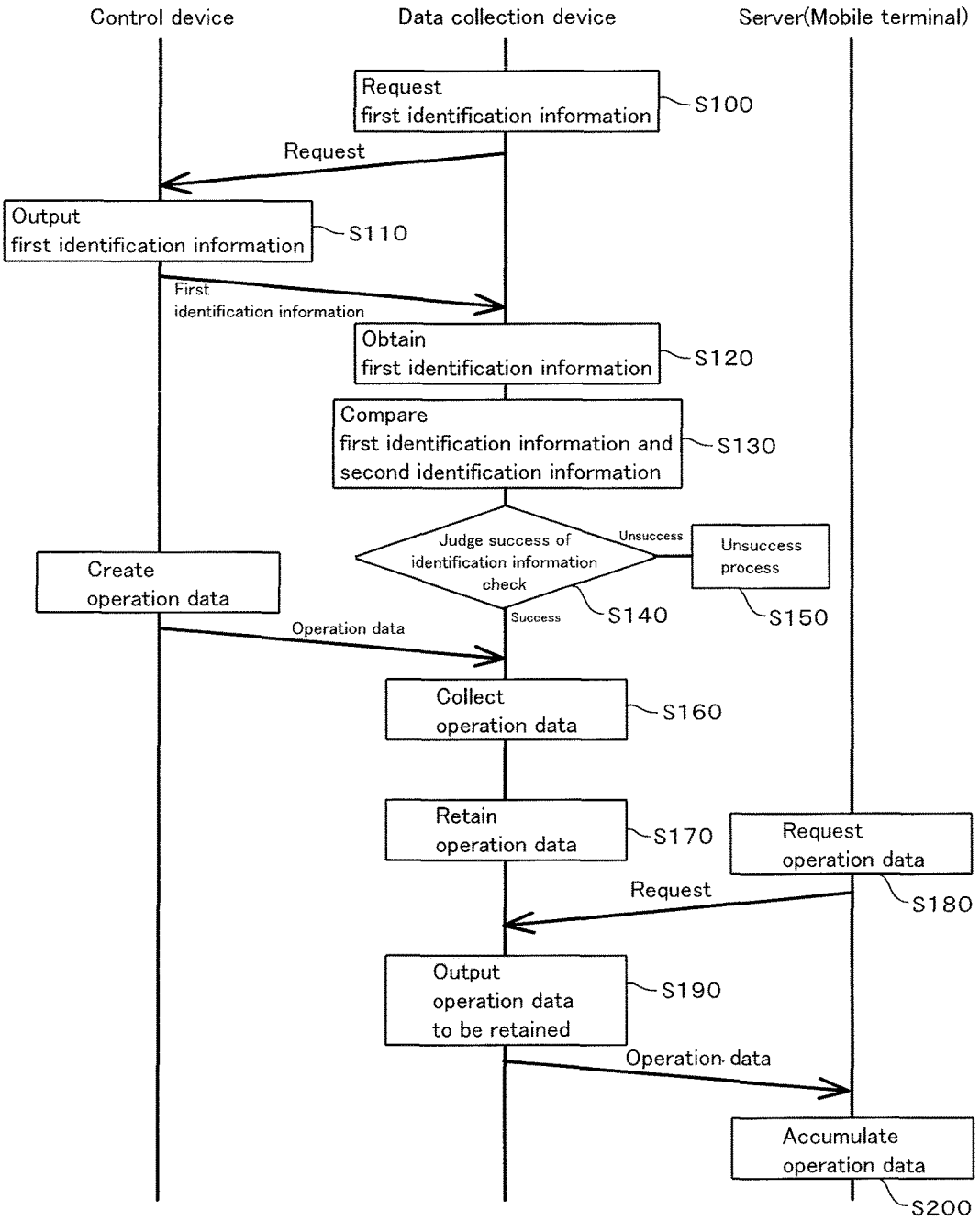
FIG. 5 is a view showing an operation of the data collection system according to the first embodiment.

As described above, summarizing the operations of the control device 6, the data collection device 5, and the like in the first embodiment, the operations are shown in FIG. 5. At first, the check part 55*a* (55*b*) of the data collection device 5*a* (5*b*) requests the agricultural machine identification information 61*a* (61*b*) from the control device 6*a* (6*b*), the agricultural machine identification information 61*a* (61*b*) being the first identification information, before the data collection device 5*a* (5*b*) starts collecting the operation data from the control device 6*a* (6*b*) (S100).

In response to the request from the check part 55*a* (55*b*), the control device 6*a* (6*b*) outputs the agricultural machine identification information 61*a* (61*b*) to the data collection device 5*a* (5*b*) (S110).

The check part 55*a* (55*b*) obtains the agricultural machine identification information 61*a* (61*b*) (S120). The check part 55*a* (55*b*) obtains the second identification information from the identification information retention part 51*a* (51*b*), and compares (checks) the agricultural machine identification information 61*a* (61*b*) with the second identification information, the agricultural machine identification information 61*a* (61*b*) being obtained from the control device 6*a* (6*b*) at the step S120 (S130). In a case where the checking for both of the first identification information and the second identification information becomes successful after the check part 55*a* (55*b*) checks the first identification information and the second identification information with each other (success at S140), the data collection processing part 56*b* starts collecting the operation data (S160), and carries out the unsuccess process described above when the checking for both of the first identification information and the second identification information is unsuccessful (unsuccess at S140) (S150).

The collection data retention part 53*a* (53*b*) adds the hour meter on the collected operation data and retains the operation data and the hour meter (S170). When the data request part 32*a* (32*b*) of the mobile terminal 3*a* (3*b*) requests sending of the collected operation data from the data collection device 5*a* (5*b*) (S180), the data collection device 5*a* (5*b*) outputs the operation data to the mobile terminal 3*a* (3*b*) in response to the request from the data request part 32*a* (32*b*), the operation data being retained in the collection data retention part 53*a* (53*b*) (S190).

The mobile terminal 3*a* (3*b*) receives the operation data outputted from the data collection device 5*a* (5*b*), and sends the received operation data to the server 2. The server 2 receives the operation data from the mobile terminal 3*a* (3*b*), and accumulates the received operation data to the collection data accumulation part 21 (S200).

Second Embodiment

Figure 6:
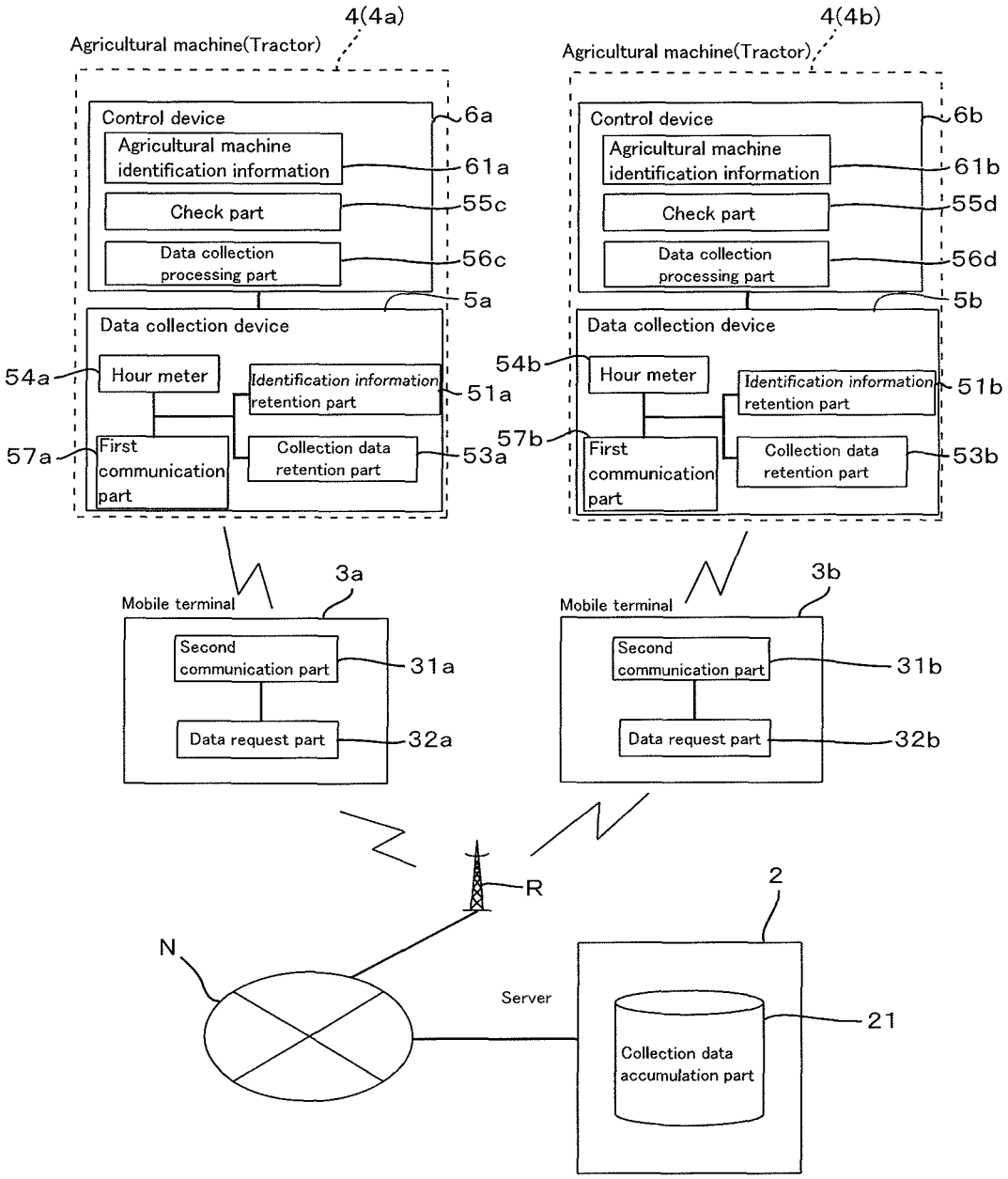
FIG. 6 is a view showing in detail a configuration of the data collection system according to a second embodiment.

In a second embodiment, as shown in FIG. 6, the control device 6*a* of the agricultural machine 4*a* includes: a check part 55*c* configured to check the first identification information with the second identification information; and the data collection processing part 56*c* configured to carry out a process for data collection on the basis of a result of the checking by the check part 55*c*.

Meanwhile, the control device 6*b* of the agricultural machine 4*b* also includes: a check part 55*d*; and the data collection processing part 56*d* configured to carry out a process for data collection on the basis of a result of the checking by the check part 55*d*; however, the check part 55*d* has a configuration approximately identical to the check part 55*c*, the data collection processing part 56*d* has a configuration approximately identical to the data collection processing part 56*c*, and accordingly explanations of the check part 55*d* and the data collection processing part 56*d* will be omitted. In addition, in the second embodiment, configurations different from the configurations of the first embodiment will be explained.

The check part 55*c* checks the agricultural machine identification information 61*a* and the second identification information with each other, the agricultural machine identification information 61*a* being the first identification information retained in the control device 6*a* of the tractor 4*a*, the second identification information being retained in the identification information retention part 51*a*. In particular, the check part 55*c* obtains the second identification information from the data collection device 5*a*, and checks (compares) the agricultural machine identification information 61*a* and the second identification information with each other, the agricultural machine identification information 61*a* being the first identification information stored in the control device 6*a*. According to the comparison, it can be judged whether the second identification information corresponds to the agricultural machine identification information 61*a*, for example, whether the second identification information is related to the agricultural machine identification information 61*a*, or whether the second identification information corresponds to the agricultural machine identification information 61*a*.

When the checking for both of the first identification information and the second identification information is successful, the data collection processing part 56*c* orders the data collection device 5*a* to start to collect the operation data flowing in the vehicle communication network as a process relating to the collection of data. The data collection device 5*a* starts to collect the operation data in accordance with the order to start the collection from the data collection processing part 56*c*. On the other hand, when the checking for both of the first identification information and the second identification information is unsuccessful, the data collection processing part 56*c* carries out the process in unsuccessful check (an unsuccess process) described below.

Next, exemplifying a case where the data collection device 5*b* is attached to the tractor 4*a* as with the first embodiment, the unsuccess process of the control device 6*a* (the data collection processing part 56*c*) will be explained, the unsuccess process being carried out when the checking for both of the first identification information and the second identification information is unsuccessful. Meanwhile, an operation of the unsuccess process of the control device 6*b* (the data collection processing part 56*d*) is approximately identical to the operation of the unsuccess process of the control device 6*a* (the data collection processing part 56*c*), and an explanation of the operation will be omitted.

The unsuccess process carried out by the data collection processing part 56*c* includes a plurality of processes, a first process to a sixth process.

In a primary process (the first process), an order is outputted to the data collection device 5*b*, the order ordering to forbid to write the operation data to the collection data retention part 53*b*. In this manner, the data collection device 5*b*, for example, is forbidden from writing the collection data group 230 shown in FIG. 4 to the collection data retention part 53*b*.

In a secondary process (the second process), an order is outputted to the data collection device 5*b*, the order ordering to protect the operation data already stored in the collection data retention part 53*b* (the operation data at the successful checking) so as not to be lost by being overwritten. In this manner, the data collection processing part 56*b* saves the collection data group 230 and the collection data groups 220 and 221 separately in the collection data retention part 53*b*, and disenables the data regions of the collection data groups 220 and 221 to be overwritten, thereby protecting the collection data groups 220 and 221 so that the operation data of the collection data groups 220 and 221 are not erased by overwriting of and saving of the collection data group 230 newly collected.

In a tertiary process (the third process), an order is outputted to the data collection device 5*b*, the order ordering to output the data already stored in the collection data retention part 53*b* (the operation data at the successful checking) to an outside such as the server 3 and the mobile terminals 3*a* and 3*b*. In this manner, the data collection device 5*b* sends the operation data of the collection data groups 220 and 221 to the server 2 and the mobile terminals 3*a* and 3*b*, the operation data being already stored in the collection data retention part 53*b*.

In a quaternary process (the fourth process), an order is outputted to the data collection device 5*b*, the order ordering to stop the collecting of the operation data by the data collection device 5*b* after the checking for both the first identification information and the second identification information is unsuccessful. In this manner, the data collection device 5*b* does not carry out the collecting of the collection data group 230 after the checking for both the first identification information and the second identification information is unsuccessful.

In a quinary process (the fifth process), an order is outputted to the data collection device 5*b*, the order ordering to relate the result of the checking for both of the first identification information and the second identification information to the operation data, and saving the operation data and the result of the checking in the collection data retention part 53*b*. In response to that, the data collection device 5*b* adds an unsucess flag F to the collection data group 230 collected after the checking is unsuccessful, the unsucess flag F indicating that the checking for both the first identification information and the second identification information is unsuccessful, and saves the unsuccess flag F and the collection data group 230 to the collection data retention part 53*b*.

Additionally, in a senary process (the sixth process), an order is outputted to the data collection device 5*b*, the order ordering to stop the hour meter of the data collection device 5*b*. In this manner, as shown in FIG. 4, in a case where the hour meter, for example, shows "99 hours 03 minutes 16 seconds (99:03:16)" immediately before the checking becomes unsuccessful, the data collection device 5*b* stops a counting process (a time counting process) of the hour meter after the "99 hours 03 minutes 16 seconds" when the checking becomes unsuccessful.

Meanwhile, the control device 6*a* (the data collection processing part 56*c*) carries out any one of the first process to the sixth process described above at the unsuccess process; however, the control device 6*a* may carry out the first process to the sixth process in combination.

As described above, summarizing the operations of the control device 6, the data collection device 5, and the like in the second embodiment, the operations are shown in FIG. 7. At first, the check part 55*c* (55*d*) of the control device 6*a* (6*b*) requests the second identification information from the data collection device 5*a* (5*b*) before the data collection device 5*a* (5*b*) starts collecting the operation data from the control device 6*a* (6*b*) (S300).

In response to the request from the check part 55*c* (55*d*), the data collection device 5*a* (5*b*) outputs the second identification information to the control device 6*a* (6*b*) (S310).

The check part 55*c* (55*d*) obtains the second identification information (S320). The check part 55*c* (55*d*) compares (checks) the agricultural machine identification information 61*a* (61*b*) with the second identification information, the second identification information being obtained from the data collection device 5*a* (5*b*) at the step S320 (S330). In a case where the checking for both of the first identification information and the second identification information becomes successful (success at S340), the data collection processing part 56*c* (56*d*) outputs an order to the data collection device, the order ordering to start collecting the operation data (S360), and the data collection device 5*a* (5*b*) starts to collect the data (S370). The data collection processing part 56*c* (56*d*) carries out the unsuccess process described above when the checking for both of the first identification information and the second identification information is unsuccessful (unsuccess at S340) (S350).

The collection data retention part 53*a* (53*b*) adds the hour meter on the collected operation data and retains the operation data and the hour meter (S380). When the data request part 32*a* (32*b*) of the mobile terminal 3*a* (3*b*) requests sending of the collected operation data from the data collection device 5*a* (5*b*) (S390), the data collection device 5*a* (5*b*) outputs the operation data to the mobile terminal 3*a* (3*b*) in response to the request from the data request part 32*a* (32*b*), the operation data being retained in the collection data retention part 53*a* (53*b*) (S400).

The mobile terminal 3*a* (3*b*) receives the operation data outputted from the data collection device 5*a* (5*b*), and sends the received operation data to the server 2. The server 2 receives the operation data from the mobile terminal 3*a* (3*b*), and accumulates the received operation data to the collection data accumulation part 21 (S410).

Meanwhile, in the first embodiment and the second embodiment each described above. the mobile terminals 3*a* and 3*b* and the server 2 are capable of receiving the operation data sent from the data collection device 5; however, the mobile terminals 3*a* and 3*b* and the server 2 do not accept the operation data sent while the checking of the first identification information with the second identification information is unsuccessful (the operation data being collected by the data collection device 5 while the checking of the first identification information with the second identification information is unsuccessful). In particular, the mobile terminals 3*a* and 3*b* and the server 2 do not receive the operation data of the collection data group 230 among the collection data groups 220 and 221 and the collection data group 230 each shown in FIG. 4. Or, even when receiving the collection data groups 220 and 221 and the collection data group 230, the mobile terminals 3*a* and 3*b* or the server 2 do not save the collection data group 230 related to the unsucess flag, and save only the collection data groups 220 and 221 not related to the unsuccess flag.

Meanwhile, the mobile terminals 3*a* and 3*b* and the server 2 may carry out a process to erase the operation data sent while the checking of the first identification information with the second identification information is unsuccessful (the operation data being collected by the data collection device 5 while the checking of the first identification information with the second identification information is unsuccessful). For example, the mobile terminals 3*a* and 3*b* and the server 2 receive the collection data groups 220 and 221 and the collection data group 230 once, and automatically erase only the collection data group 230 after saving the operation data of the collection data groups 220 and 221 and of the collection data group 230.

Third Embodiment

Figure 9:
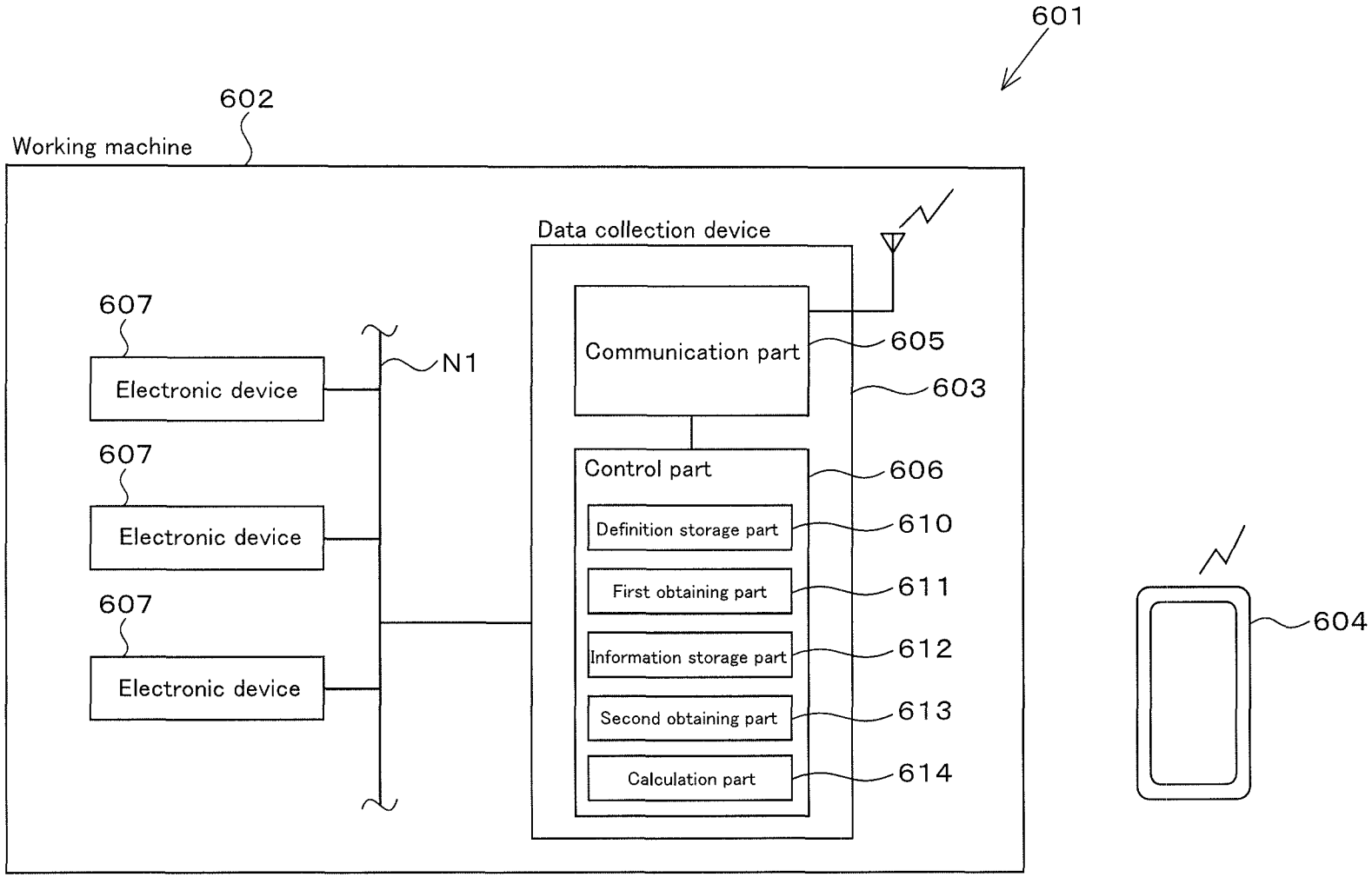
FIG. 9 is an overall view of an information collection system of a working machine.

FIG. 9 shows an overall view of an information collection system of a working machine.

As shown in FIG. 9, an information collection system 601 of a working machine is a system for collecting data (signals) of a working machine 602 such as an agricultural machine and a construction machine by using a data collection device 603 and the like. The data collection device 603 is connected to an in-vehicle network N1 disposed on the working machine 602 by a connector and the like, thereby being freely attachable to and detachable from the in-vehicle network N1, and obtains the data flowing in the in-vehicle network N1. The in-vehicle network N1 is the Controller Area Network (CAN), the Local Interconnect Network (LIN), the FlexRay, or the like, and connects various types of electronic devices (electric components) 607 with each other, the electronic devices being mounted on the working machine 602, thereby sending and receiving various types of data outputted from the electronic devices. Hereinafter, for convenience in the explanation, a value (a unique value) of data flowing in the in-vehicle network is referred to as a parameter or a parameter value. Meanwhile, the electronic device (the electric component) 7 is a sensor, a switch, a CPU, an MPU, and the like, and may be anything mounted on the working machine 602.

The data collection device 603 includes a communication part (an input-output part) 605 and a control part 606. The communication part 605 communicates with an outside in wireless, and carries out a communication in wireless, for example, in the Wi-Fi (Wireless Fidelity, registered trademark) of the IEEE802.11 series that is a communication standard. In particular, the communication part 605 converts the data received from the outside into a communication system of the data collection device 603 to output the data to the control part 606, and converts the data sent from the control part 606 into a communication system of the IEEE802.11 series to output the data to the outside. That is, the communication part 605 outputs the data (the signals) received from the outside to the control part 606, and sends, to the outside, the data (the signals) outputted from the control part 606.

The control part 606 is constituted of a CPU and the like, and carries out various types of processes relating to data outputted to the in-vehicle network N1. The control part 606, for example, obtains the parameter (the parameter value) in units of group (a unit collectively including the plurality of parameters), the parameter being outputted to the in-vehicle network N1, or obtains the parameter individually.

<Parameter Group (PG), and Obtaining the Parameter in Units of PG>

The obtaining of the parameter (the data) by the control part 606 will be explained below.

As shown in FIG. 9, the control part 606 includes a definition storage part 610. The definition storage part 610 is constituted of a nonvolatile memory or the like, and stores information relating to the obtaining of and the saving of the parameter.

In particular, as shown in FIG. 10, the definition storage part 610 stores a parameter group (a data group). The parameter group defines a parameter and a group by relating the parameter and the group to each other, the parameter being collected by the data collection device 603, the group to which the parameter belongs. The group is a unit for collectively handling the parameters to simplify the handling of the parameters; the parameters having similarity with each other are set as an identical group, and the parameters having relativity with each other are set as an identical group. The relationship between the group and the parameter belonging to the group is determined by a manufacturer or the like manufacturing the working machine 602.

To be detailed, the parameter group is data defining a group mane, a communication speed, a data size, first identification information of the parameter group (PGN), a parameter name of the parameter belonging to the group, and the like, and is data determining, for each of the groups, the group name, the communication speed, the data size, the first identification information, the parameter name of the parameter belong to the group.

In this manner, referring to the parameter group, it can be judged which group does the parameter belong to. For example, as shown in FIG. 10, a parameter showing an "error existence", a parameter showing an "engine revolution speed", and a parameter showing a "coolant temperature" belong to the group having the group name "engine", and can be identified on the basis of the PGN (for example, 642239).

As shown in FIG. 9, a first obtaining part 611 carries out a process of obtaining the parameters (parameter values) in units of groups, the first obtaining part 611 being included in the control part 606. The first obtaining part 611 is constituted of a computer program or the like, the computer program being stored in the control part 606.

A frame is sequentially inputted to the data collection device 603 in a broadcasting communication under a state where the working machine 602 operates, the frame having the parameters flowing in the in-vehicle network N1 (the frame preliminarily set in the in-vehicle network). The frame includes a plurality of the parameters belonging to a predetermined group, and includes the first identification information (the PGN) used for identifying the group.

Under a state where the frame is inputted to the data collection device 603, the obtaining part 611 monitors the PGN included in the frame. Here, the first obtaining part 611 obtains (receives) the frame when the frame is inputted to the data collection device 603, the frame including the PGN defined by the parameter group, the parameter group being stored in the definition storage part 610. That is, the first obtaining part 611 receives the frame when the PGN included in the frame is identical to the PGN of the parameter group.

For example, consider that three frames are inputted to the data collection device 603. At that time, in a case where the PGNs included in a first frame (1st frame) and a second frame (2nd frame) are not set to the parameter group stored in the definition storage part 610, the first obtaining part 611 does not receive the first frame and the second frame. On the other hand, in a case where the PGN included in a third frame (3rd frame) is preliminarily set to the parameter group, the first obtaining part 611 receives the third frame.

FIG. 11 shows a group obtaining table of the parameter included in the "engine group", the engine group being obtained by the first obtaining part 611 when the PGN of the third frame is "642239", for example. Obtained parameters (the error existence, the engine revolution speed, and the coolant temperature) and the PGN showing the group are related to each other in the group obtaining table, the group obtaining table being configured when the third frame is obtained. In this manner, the first obtaining part 611 is capable of obtaining the parameters in units of the groups, the parameter belonging to the group shown in the parameter group.

<Saving the Parameter in Units of PG>

Meanwhile, as shown in FIG. 9, the data collection device 603 includes an information storage part 612, and the parameter obtained in units of the group is saved in the information storage part 612. A process of saving the parameter in the information storage part 612 is carried out on the basis of a save condition preliminarily determined.

Figure 12:
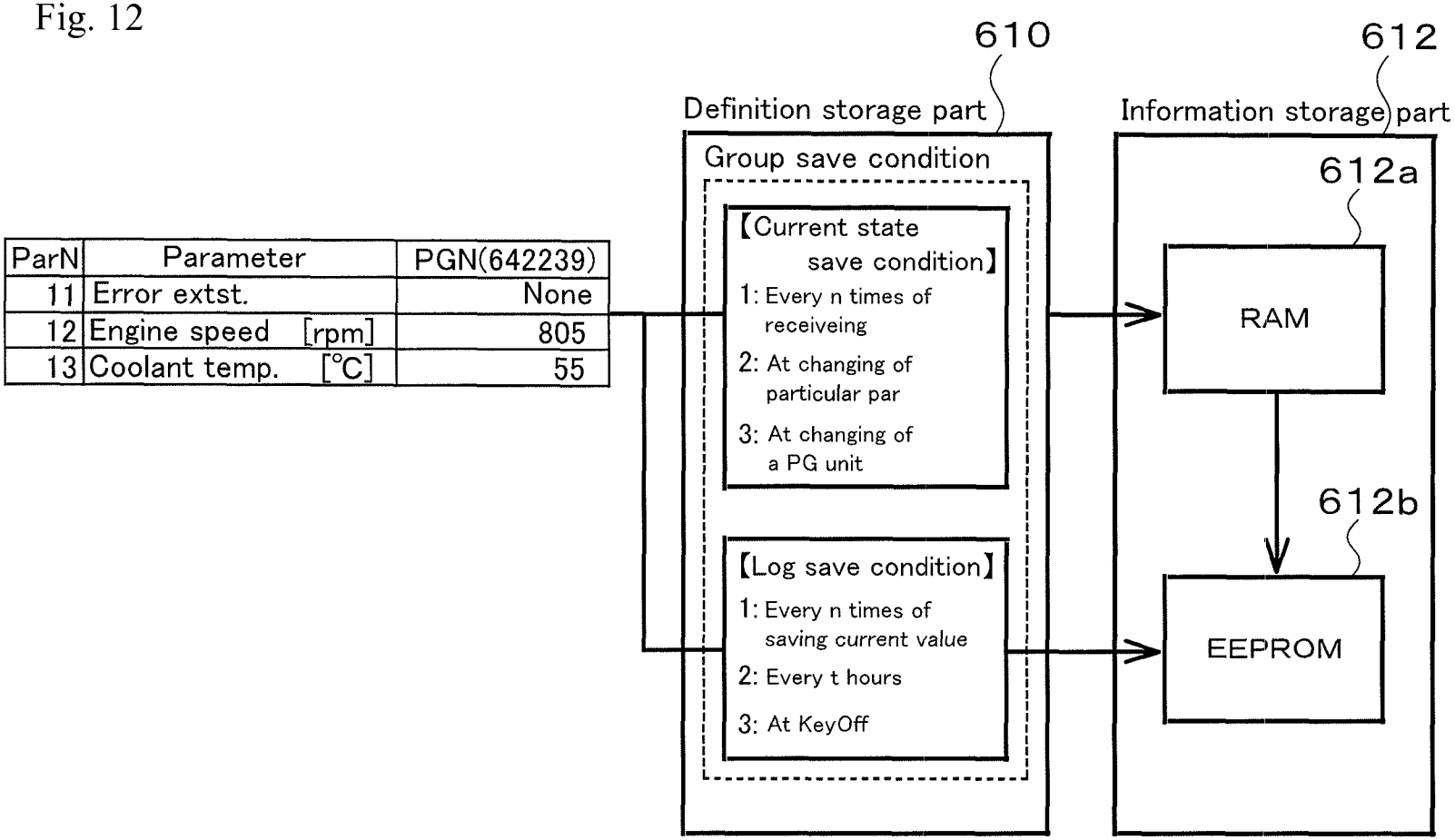
FIG. 12 is an explanation view explaining a group save condition.

As shown in FIG. 12, the definition storage part 610 stores a save condition (a group save condition) under which a parameter group (the group obtaining table) is saved, the parameter group collectively including the plurality of parameters obtained in units of the group, that is, the parameters belonging to a predetermined group, other than the parameter group described above.

The group save condition includes a current state save condition and a log save condition (a history save condition), the current state save condition showing a condition to temporarily save the parameter group having been obtained (the group obtaining table), the log save condition showing a condition to save the save the parameter group having been obtained (the group obtaining table) for a long term.

To be detailed, the information storage part 612 includes: a RAM 612*a* constituted of a nonvolatile memory; and an EEPROM 612*b* constituted of a nonvolatile memory. The current state save condition is a condition to save the parameter group to the RAM 612*a*, and the log save condition is a condition to save the parameter group to the EEPROM 612*b*.

The current state save condition is a condition suitable to temporarily save the latest parameter group (save the parameter to the RAM 612*a*), and three conditions, "every n times of receiving", "at changing of a particular par", and "at changing of a PG unit", are prepared as the current state save condition.

Here, the condition "every n times of receiving" shows that the parameter group (the group obtaining table) obtained by the first obtaining part 611 is saved to the RAM 612*a* every n times of receiving (obtaining) an identical parameter group (the group obtaining table of an identical PGN). In that case, the first obtaining part 611 counts the number of obtaining (the number of receiving) a predetermined parameter group (the group obtaining table of an identical PGN), and saves, to the RAM 612*a*, only the parameter group obtained n times. The number of the obtaining (the number of the receiving) is reset (to an initial value) every n times. Meanwhile, the first obtaining part 611 may save the parameter group to the RAM 612*a* when the number of the obtaining reaches a multiple of n.

The "at changing of a particular par" shows that the parameter group is saved to the RAM 612*a* only when the parameter (a target parameter) preliminarily set is changed in the parameter group (the group obtaining table) having been obtained. In that case, the first obtaining part 611 judges whether the parameter showing the "error existence" is changed from the parameter previously obtained, when the parameter "error existence" is determined as a target parameter, for example. Then, the first obtaining part 611 saves, to the RAM 612*a*, all of the parameters (for example, the error existence, the engine revolution speed, and the coolant temperature) of the group including the "error existence" when the parameter showing the "error existence" is changed.

The "at changing of a PG unit" shows that in a case where the parameter group is obtained, the parameter group (the group obtaining table) is saved when at least one of the parameters of the parameter group is changed in the parameter group having been obtained. In that case, the first obtaining part 611 judges whether any one of the parameters, the "error existence", the "engine revolution speed", and the coolant temperature, is changed from the parameters previously obtained, when the parameter "error existence" is determined as a target parameter, for example. Then, the first obtaining part 611 saves the parameter group (the group obtaining table) when at least one of the parameters, the "error existence", the "engine revolution speed", and the coolant temperature, is changed.

As described above, after obtaining the parameter group, the first obtaining part 611 saves the parameter group (the group obtaining table) having been obtained is saved to the RAM 612*a* when at least one of the save conditions, the "every n times of receiving", the "at changing of a particular par", and the "at changing of a PG unit", is satisfied; however, the definition storage part 610 may save any one of the save conditions, the "every n times of receiving", the "at changing of a particular par", and the "at changing of a PG unit", and additionally the first obtaining part 611 may carry out the saving of the parameter group (the group obtaining table). Meanwhile, the current state save condition is not limited to the example described above.

The log save condition is suitable for saving the parameters for a long term (saving the parameters to the EEPROM 612*b*), and three conditions, that is, "every n times of saving current value", the "every t hours", and the "at Key Off", are prepared as the log save condition.

The "every n times of saving current value" shows that the parameter group (the group obtaining table) is saved to the EEPROM 612*b* every time when the parameter group (the group obtaining table) has been saved n times on the basis of the current state save condition (every time when the group obtaining table of an identical PGN has been saved n times to the RAM 612*a*). In that case, the first obtaining part 611 counts the number of saving a predetermined parameter group (the group obtaining table of an identical PGN) to the RAM 612*a*, reads, from the RAM 612*a*, only the parameter group (the group obtaining table) obtained at a timing when the number of saving reaches n, and saves the parameter group to the EEPROM 612*b*. The number of the saving is reset (to an initial value) when the number of saving a predetermined parameter group to the RAM 612*a* reaches n. Meanwhile, the first obtaining part 611 may save the parameter group to the EEPROM 612*b* when the number of the saving reaches a multiple of n.

The "every t hours" shows that the parameter group (the group obtaining table) obtained by the first obtaining part 611 is saved to the EEPROM 612*b* every time when t hours have passed. In that case, the first obtaining part 611 counts time by using a counter or the like, and saves the parameter group every time when t hours have passed after completion of the saving to the EEPROM 612*b*.

The "at Key Off" shows that the parameter group (the group obtaining table) obtained by the first obtaining part 611 is saved to the EEPROM 612*b* when an engine key (for example, an ignition key) for driving a power source (an engine or the like) is turned off, the power source being mounted on the working machine 602. In that case, the first obtaining part 611 monitors the ignition key in collecting the parameters; thus when the ignition key is turned on, the first obtaining part 611 does not save the parameter group (the group obtaining table) having been obtained, and when the ignition key is turned off, the first obtaining part 611 saves the parameter group to the EEPROM 612*b*.

As described above, after the parameter group is obtained, the first obtaining part 611 saves, to the EEPROM 612*b*, the parameter group (the group obtaining table) having been obtained, when any one of the save conditions, the "every n times of saving current value", the "every t hours", and the "at Key Off", is satisfied; however, the definition storage part 610 may save any one of the save conditions, the "every n times of saving current value", the "every t hours", and the "at Key Off", and additionally the first obtaining part 611 may carry out the saving of the parameter group (the group obtaining table). Meanwhile, the log save condition is not limited to the example described above.

As described above, the definition storage part 610 stores the group save conditions (for example, the current state save conditions and the log save conditions) under which the parameter group is saved to the information storage part 612 (for example, the RAM 612*a* and the EEPROM 612*b*), and the first obtaining part 611 saves the parameter group (the group obtaining table) to the information storage part 612 on the basis of the group save conditions; thereby, useless saving of the parameters is prevented, and the information storage part 612 is efficiently used.

<Obtaining the Parameter (Par) in Individual Units>

Then, as described above, the data collection device 603 obtains the parameters (the parameter values) in units of group; however, in addition to that, the data collection device 603 obtains the parameter also in individual units.

A process of obtaining the parameters in individual units is carried out by a second obtaining part 613 included in the control part 606. The second obtaining part 613 is constituted of a computer program or the like stored in the control part 606.

Figure 13:
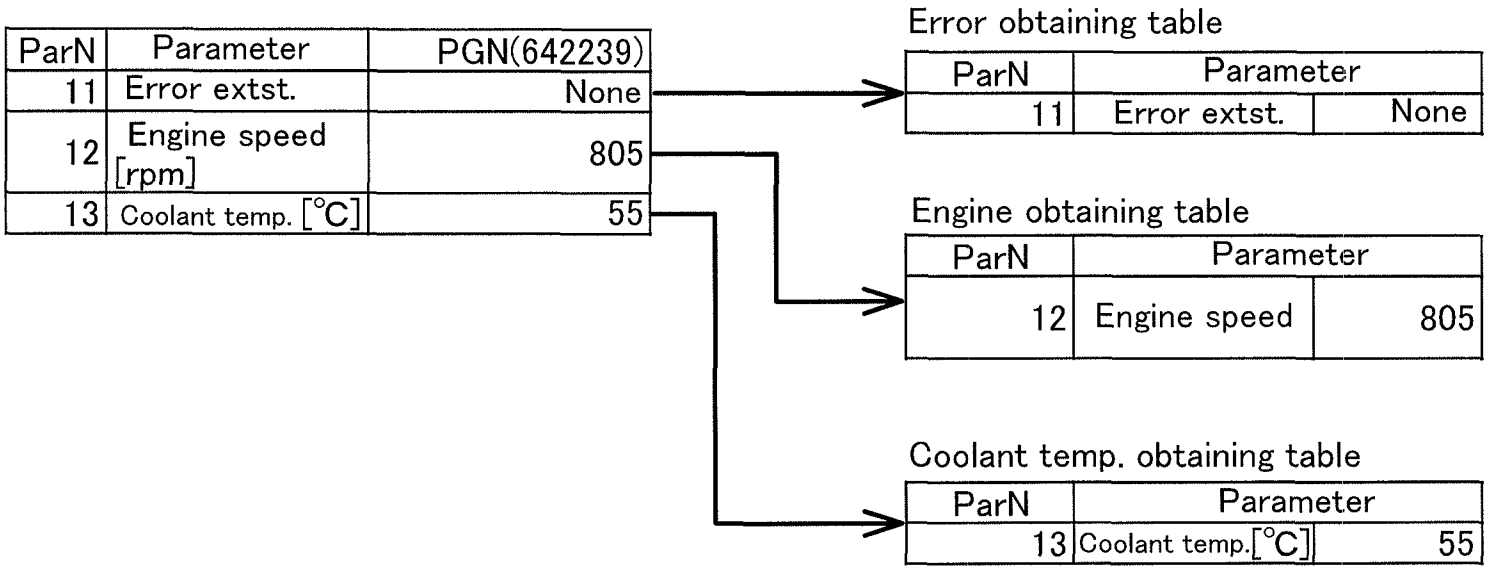
FIG. 13 is an explanation view explaining division of an individual parameter from a parameter group.

As shown in FIG. 13, the second obtaining part 613 divides obtained parameter group into individual parameters when the first obtaining part 611 has obtained the parameters in units of group, and obtains the individual parameters separately from the parameter group. For example, when the first obtaining part 611 obtains the frame including the parameters belonging to the engine group, the second obtaining part 613 divides data, the data being stored in the frame, into the parameter showing the "error existence", the parameter showing the "engine revolution speed", and the parameter showing the "coolant temperature", and obtains each of the parameters separately from the parameter group described above. That is, as shown in FIG. 13, the second obtaining part 613 creates: an error obtaining table of the parameter showing the "error existence"; an engine obtaining table of the parameter showing the "engine revolution speed"; and a coolant temperature obtaining table of the parameter showing the "coolant temperature".

The second obtaining part 613 relates the parameter showing an error existence to the second identification information (referred to as ParN) in the error obtaining table, the second identification information being used for identifying that the parameter is the "error existence". Additionally, in the same manner, the second obtaining part 613 relates the parameter showing an engine revolution speed to the Par N also in the engine obtaining table, the Par N being used for identifying that the parameter is the "engine revolution speed", and relates the parameter showing a coolant temperature to the Par N also in the coolant temperature obtaining table, the Par N being used for identifying that the parameter is the "coolant temperature".

That is, the second obtaining part 613 is capable of sequentially and individually obtaining the parameters showing the "error existence" (the error obtaining table), sequentially obtaining the parameters showing the "engine revolution speed" (the engine obtaining table), and sequentially obtaining the parameters showing the "coolant temperature" (the coolant temperature obtaining table). To be summarized, the second obtaining part 613 is capable of obtaining the individual parameters by dividing the parameters in individual units, the parameters being obtained in units of the group obtained by the first obtaining part 611.

Hereinafter, the parameter in individual units is referred to as an individual parameter; the parameter showing the "error existence" is a first parameter, the parameter showing the "engine revolution speed" is a second parameter, and the parameter showing the "coolant temperature" is a third parameter, in the following explanations. Moreover, each of the error obtaining table, the engine obtaining table, and the coolant temperature obtaining table is referred to as an individual obtaining table in the following explanations.

<Saving the Parameter, the Par>

The individual parameter is saved to the information storage part 612. A process of saving the individual parameter to the information storage part 612 is also carried out on the basis of the save conditions preliminarily determined.

Figure 14:
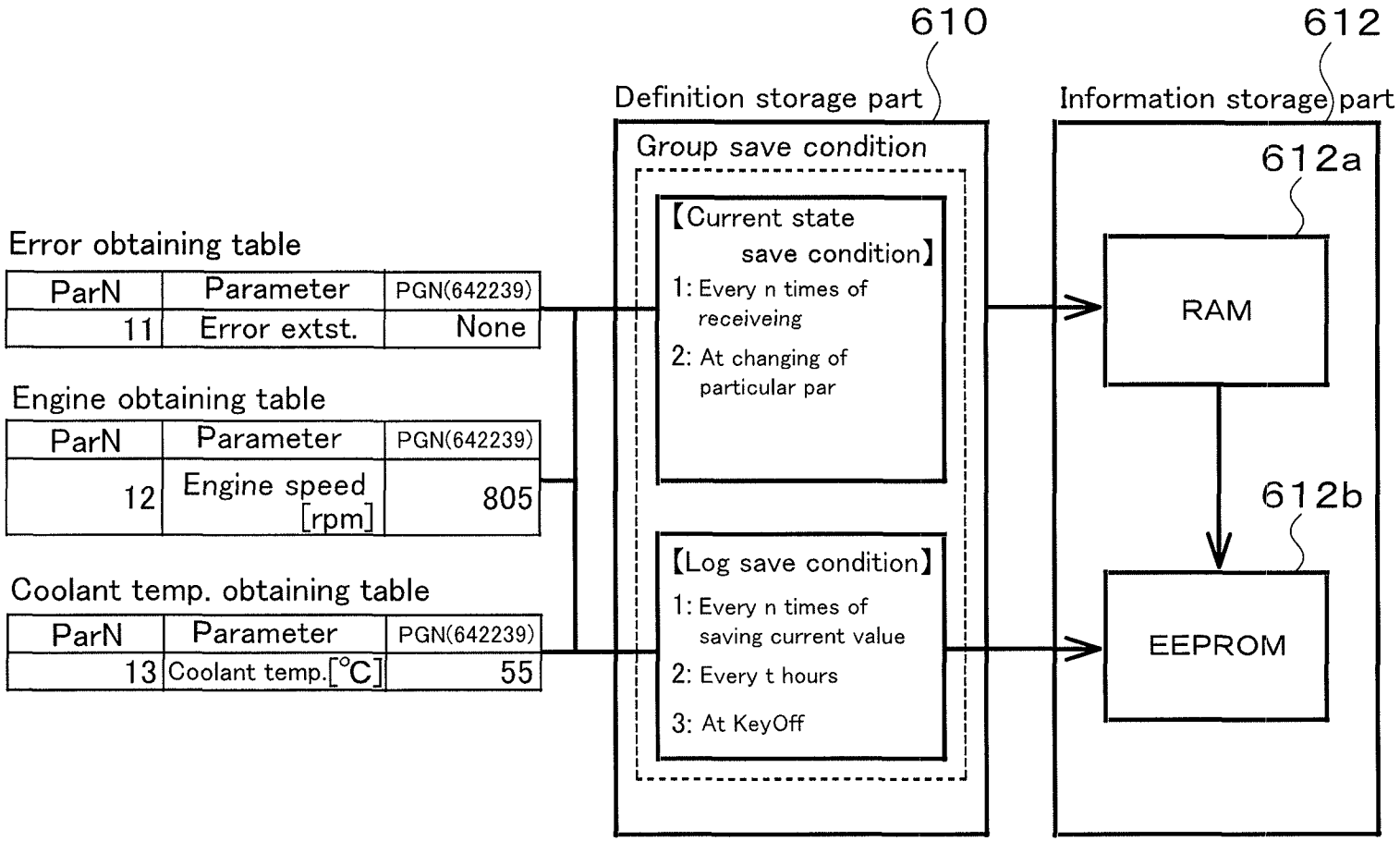
FIG. 14 is an explanation view explaining an individual save condition.

As shown in FIG. 14, the definition storage part 610 stores a save condition (an individual save condition) under which the individual parameter is saved, other than the parameter group and the group save conditions each described above.

As shown in FIG. 14, the individual save condition also includes a current state save condition and a log save condition (a history save condition), the current state save condition showing a condition to temporarily save the individual parameter having been obtained (the individual obtaining table), the log save condition showing a condition to save the save the individual parameter having been obtained (the individual obtaining table) for a long term. In the following explanation of the individual save condition. The "engine obtaining table", one of the individual obtaining tables, is exemplified.

The current state save condition is a condition suitable to temporarily save the latest individual parameter (save the individual parameter to the RAM 612*a*), and two conditions, "every n times of receiving" and "at changing of a particular par", are prepared as the current state save condition.

Here, the condition "every n times of receiving" shows that the individual parameter (the engine obtaining table) obtained by the second obtaining part 613 is saved to the RAM 612*a* every n times of receiving (obtaining) an identical individual parameter (the engine obtaining table).

In that case, the second obtaining part 613 counts the number of obtaining (the number of receiving) a predetermined individual parameter (the engine obtaining table), and saves, to the RAM 612*a*, only the individual parameter (the engine obtaining table) obtained n times. The number of the obtaining (the number of the receiving) is reset (to an initial value) every n times. Meanwhile, the second obtaining part 613 may save the individual parameter (the engine obtaining table) to the RAM 612*a* when the number of the obtaining reaches a multiple of n.

The "at changing of a particular par" shows that the individual parameter (the engine obtaining table) is saved to the RAM 612*a* only when the parameter (a target parameter) preliminarily set is changed in the individual parameter having been obtained. In that case, the second obtaining part 613 judges whether a second parameter showing the "engine revolution speed" is changed from the parameter previously obtained, when the second parameter "engine revolution speed" is determined as a target parameter, for example. Then, the second obtaining part 613 saves, to the RAM 612*a*, the second parameter, that is, the engine obtaining table when the second parameter is changed.

As described above, after obtaining the individual parameter (the engine obtaining table), the second obtaining part 613 saves the individual parameter (the engine obtaining table) having been obtained is saved to the RAM 612*a* when at least one of the save conditions, the "every n times of receiving" and the "at changing of a particular par" is satisfied; however, the definition storage part 610 may save any one of the save conditions, the "every n times of receiving" and the "at changing of a particular par", and additionally the second obtaining part 613 may carry out the saving of the individual parameter (the engine obtaining table). Meanwhile, the current state save condition is not limited to the example described above. In addition, the log save condition is suitable for saving the individual parameter for a long term (saving to the EEPROM 612*b*), and three conditions, "every n times of saving current value", the "every t hours", and the "at Key Off", are prepared as the log save condition.

The "every n times of saving current value" shows that the individual parameter (the engine obtaining table) is saved to the EEPROM 612*b* every time when the individual parameter has been saved n times on the basis of the current state save condition (every time when the engine obtaining table has been saved n times to the RAM 612*a*). In that case, the second obtaining part 613 counts the number of saving a predetermined individual parameter group (the engine obtaining table) to the RAM 612*a*, reads, from the RAM 612*a*, only the individual parameter (the engine obtaining table) obtained at a timing when the number of saving reaches n, and saves the individual parameter to the EEPROM 612*b*. The number of the saving is reset (to an initial value) when the number of the saving reaches n. Meanwhile, the second obtaining part 613 may save the individual parameter (the engine obtaining table) to the EEPROM 612*b* when the number of the saving reaches a multiple of n.

The "every t hours" shows that the individual parameter (the engine obtaining table) obtained by the second obtaining part 613 is saved to the EEPROM 612*b* every time when t hours have passed. In that case, the second obtaining part 613 counts time by using a counter or the like, and saves the individual parameter every time when t hours have passed after completion of the saving to the EEPROM 612*b*.

The "at Key Off" shows that the individual parameter obtained by the second obtaining part 613 is saved to the EEPROM 612*b* when the engine key (for example, the ignition key) for driving the power source (the engine or the like) is turned off, the power source being mounted on the working machine 602. In that case, the second obtaining part 613 monitors the ignition key in collecting the parameters; thus when the ignition key is turned on, the second obtaining part 613 does not save the individual parameter (the engine obtaining table) having been obtained, and when the ignition key is turned off, the second obtaining part 613 saves the individual parameter to the EEPROM 612*b*.

As described above, after the individual parameter (the engine obtaining table) is obtained, the second obtaining part 613 saves, to the EEPROM 612*b*, the individual parameter (the engine obtaining table) having been obtained, when any one of the save conditions, the "every n times of saving current value", the "every t hours", and the "at Key Off", is satisfied; however, the definition storage part 610 may save any one of the save conditions, the "every n times of saving current value", the "every t hours", and the "at Key Off", and additionally the second obtaining part 613 may carry out the saving of the individual parameter (the engine obtaining table). Meanwhile, the log save condition is not limited to the example described above.

In the above descried explanation of the individual save condition, the "engine obtaining table" is exemplified and explained, however, the "error obtaining table" and the "coolant temperature obtaining table" are also saved on the basis of the individual save condition.

As described above, the individual save conditions (for example, the current state save conditions and the log save conditions) under which the individual parameter is saved to the information storage part 612 (for example, the RAM 612*a* and the EEPROM 612*b*) are stored, and the second obtaining part 613 saves the individual parameter (the individual obtaining table) to the information storage part 612 on the basis of the individual save conditions; thereby, useless saving of the individual parameters (the individual obtaining table) is prevented, and the information storage part 612 is efficiently used.

<First Condition (the Individual Save Condition) of the Definition File>

Meanwhile, the individual save condition described above is shown in the definition file showing: information relating to the group obtaining table; and information relating to the individual obtaining table. The definition file is determined for each of the machine types of the working machines 602, and is stored in the definition storage part 610. FIG. 15 shows an example of the definition file.

As shown in FIG. 15, the definition file is constituted of data relating: the "PGN" serving as the first identification information of the parameter group; the "ParN" serving as the second identification information of the individual parameter; and the individual save conditions (for example, the current state save condition and the log save condition) to each other.

The second obtaining part 613 firstly refers to the ParN corresponding to the individual parameter being to be saved, to the PGN of the group including the individual parameter, and to the definition file, in saving the individual parameter having been obtained, and the second obtaining part 613 extracts the individual save condition from the definition file. For example, as shown in FIG. 15, the second obtaining part 613 employs the "every n times of saving current value" corresponding to the ParN and the PGN as the current state save condition, and employs the "every t hours" as the log save condition, when the ParN of the second parameter (the parameter showing the engine revolution speed) is "12" and the PGN including the second parameter is "642239". Then, the second obtaining part 613 saves the second parameter to the RAM 612*a* every n times of receiving, and saves the second parameter to the EEPROM 612*b* every t hours.

That is, the second obtaining part 613 extracts the individual save condition of the individual parameter on the basis of: the first identification information of the group to which the individual parameter belonged; the second identification information of the parameter corresponding to the individual parameter; and the definition file, and saves the individual parameter to the information storage part 612 on the basis of the individual save condition having been extracted. In particular, the second obtaining part 613 divides the parameters (the parameter group) into the individual parameters, the parameters (the parameter group) being obtained by the first obtaining part 611 in units of the group, and saves the individual parameter satisfying the save condition defined in the definition file from among the individual parameters having been divided.

<Outputting (Sending) the Parameter>

Then, the parameters saved in the RAM 612*a* and in the EEPROM 612*b* are outputted to an outside through the communication part (the input-output part) 605. In particular, the communication part (the input-output part) 605 sends the parameter to a mobile terminal 604 constituted of a smartphone (multifunctional mobile phone) or a mobile computer such as a tablet PC, which has a relatively high computing capability. The mobile terminal 604 carries out the wireless communication with the communication part 605 in the Wi-Fi (Wireless Fidelity, registered trademark) of the IEEE802.11 series that is a communication standard; for example, when the mobile terminal 604 requests the parameter, the communication part 605 reads, through the control part 606, the parameter group (the group obtaining table) and the individual parameters (the individual obtaining table) each saved in the EEPROM 612*b*, and sends the parameter having been read to the mobile terminal 604.

In addition, under a state where the wireless communication between the mobile terminal 604 and the communication part 605 is established, the communication part 605 reads the parameter group (the group obtaining table) and the individual parameters (the individual obtaining table) each saved in the RAM 612*a*, and sequentially sends the parameter to the mobile terminal 604. That is, the communication part 605 sends the parameter saved in the RAM 612*a* toward the mobile terminal 604 in a push sending manner.

As described above, the first obtaining part 611 and the second obtaining part 613 are capable of obtaining the parameters in units of group, the parameters belonging to the group, and also capable of obtaining the parameters in individual units.

For this reason, watching the parameters obtained in units of group, that is, the group obtaining table, it is possible to immediately know how the parameters are configured at a certain timing. For example, the parameter of the error existence, the parameter of the engine revolution speed, and the parameter of the coolant temperature are obtained as a group, and accordingly values of the engine revolution speed and the coolant temperature, especially the values at occurrence of the error, can be immediately known on the basis of the group obtaining table.

On the other hand, watching the parameters in individual units, that is, the individual obtaining table, change and trend of a predetermined parameter can be immediately known. For example, since the parameter of the engine revolution speed is obtained individually, the change of the engine revolution speed and the trend of the engine revolution speed for a predetermined period can be immediately known on the b basis of the engine obtaining table.

In addition, the first obtaining part 611 and the second obtaining part 613 are capable of saving, to the RAM 612*a* and the EEPROM 612*b*, the parameters obtained in units of group; and the parameters obtained in individual units, on the basis of the save conditions. Accordingly, though a large number of the parameters are outputted to the in-vehicle network for a short period, necessary parameters can be obtained at a necessary interval on the basis of the save conditions. For example, the information relating to the error is needed when the error occurs, and thus an interval of the saving is not required to be shorter than an interval of the saving of the engine revolution speed. On the other hand, since the engine revolution speed is needed during an operation of the working machine 602, the engine revolution speed is required to be saved frequently than the information relating to the error.

As described above, the parameters saved in the information storage part 612 (for example, the RAM 612*a* and the EEPROM 612*b*) are sent to the outside such as the mobile terminal 604 through the communication part 605, and thereby the mobile terminal 604 obtains the parameters of the working machine 602. And, a state of operations having been carried out by the working machine 602 can be analyzed by sorting the parameters obtained by the mobile terminal 604 and the like. In addition, the parameter of the operations having been carried out by the working machine 602 can be obtained as operation information on a side of the mobile terminal 604.

<Calculation Condition>

In the embodiment described above, the second obtaining part 613 obtains and saves the individual parameter (the individual obtaining table); however, it is preferred to calculate the individual parameter before the individual parameter is saved to the information storage part 612 (the RAM 612*a* and the EEPROM 612*b*) and then to save the calculation result to the information storage part 612. Next, a case of the calculation and the saving of the individual parameter (an modified example) will be explained.

The calculation of the individual parameter is carried out by a calculation part 614 disposed on the control part 606. The calculation part 614 is constituted of a computer program or the like stored in the control part 606. The calculation part 614 calculates the individual parameter on the basis of a calculation condition preliminarily determined.

Four conditions, that is, "accumulation", "counting", "statistics", and "frequency", are prepared as the calculation conditions. The "accumulation" shows calculation of a time length where an identical individual parameter (the individual obtaining table of an identical ParN) meets a value preliminarily specified (a specified value) in a predetermined time. The specified value is preliminarily determined for each of the individual parameters. For example, assume that the engine revolution speed "800 rpm" is set as the specified value. In that case, under a state where the second obtaining part 613 continuously obtains the parameter (the second parameter) showing the engine revolution speed, the calculation part 614 calculates the time length where the second parameter meets the "800 rpm" in a predetermined time.

The "counting" shows calculation of the number where an identical individual parameter (the individual obtaining table of an identical ParN) meets a value within a range preliminarily specified (a specified range) in a predetermined time. For example, a range "600 rpm to 800 rpm" (a first specified range), a range "801 rpm to 1000 rpm" (a second specified range", a range "1001 rpm to 1500 rpm" (a third specified range), and a range "1501 rpm or more" (a fourth specified range) are set as the specified range of the engine revolution speed.

In that case, under a state where the second obtaining part 613 continuously obtains the second parameter (the engine revolution speed), the calculation part 614 calculates the number of meeting the first specified range in a predetermined time, the number of meeting the second specified range in a predetermined time, the number of meeting the third specified range in a predetermined time, and the number of meeting the fourth specified range in a predetermined time.

The "statistics" shows calculation of an average value, the maximum value, and the minimum value of an identical individual parameter (the individual obtaining table of an identical ParN). For example, under a state where the second obtaining part 613 continuously obtains the second parameter (the engine revolution speed), the calculation part 614 calculates an average value, the maximum value, and the minimum value of the engine revolution speed obtained in a predetermined time.

The "frequency" shows calculation of a time length where an identical individual parameter (the individual obtaining table of an identical ParN) meets a value within a range preliminarily specified (a specified range). For example, assume that a first specified range, a second specified range, a third specified range, and a fourth specified range are set as the specified range of the engine revolution speed, as in the "counting". In that case, under a state where the second obtaining part 613 continuously obtains the parameter (the second parameter) showing the engine revolution speed, the calculation part 614 calculates a time length where the second parameter meets a value within the first specified range, a time length where the second parameter meets a value within the second specified range, a time length where the second parameter meets a value within the third specified range, and a time length where the second parameter meets a value within the fourth specified range. Meanwhile, it is preferred to stop the calculation when the second parameter has been out of the specified range preliminarily determined. For example, under a state where the calculation part 614 calculates, by using the second parameter, a time length satisfying the "801 rpm to 1000 rpm" (the second specified range), the calculation part 614 completes the calculation of the time length at a point of time when the second obtaining part 613 has obtained the second parameter (for example, 680 rpm) being out of the second specified range, the time length satisfying the second specified range.

Then, the individual parameters calculated under the calculation conditions, the "accumulation", the "counting", the "statistics", and the "frequency" are sequentially saved to the RAM 612*a* after the completion of the calculation.

<Second Condition (the Calculation Condition) of the Definition File>

Meanwhile, the calculation condition described above is shown in the definition file. FIG. 16 shows an example of the definition file including the individual save condition and the calculation condition.

As shown in FIG. 16, the definition file is constituted of data relating the PGN, the ParN, the individual save condition, and the calculation condition to each other.

In calculating the individual parameter having been obtained, the second obtaining part 613 firstly refers to the ParN corresponding to the individual parameter being to be calculated, the PGN of the group to which the individual parameter belongs, and the definition file, and extracts the current state save condition and the calculation condition from the definition file. For example, as shown in FIG. 16, the second obtaining part 613 employs the "every n times of receiving" corresponding to the ParN and the PGN as the current state save condition, and employs the "frequency" as the calculation condition, when the ParN of the second parameter (the parameter showing the engine revolution speed) is "12" and the PGN including the second parameter is "642239". Then, the second obtaining part 613 obtains the second parameter (the engine revolution speed) every n times of the receiving, and the calculation part 614 calculates the frequency of the engine revolution speed, that is, calculates the time length where the engine revolution speed meets each of the first specified range to the fourth specified range for each of the specified ranges, using: the second parameter obtained every n times of the receiving; and the calculation condition "frequency". Then, the second obtaining part 613 saves the calculation result to the EEPROM 612*b* when the calculation is completed.

In addition, the second obtaining part 613 refers to the ParN, the PGN, and the definition file, extracts the log save condition, and stores the calculation result to the EEPROM 612*b* on the basis of the log save condition.

As described above, according to the calculation part 614 and the like, the calculation part 614 is capable of calculating the individual parameter on the basis of the calculation condition specified in the definition file, saving the calculation result of the individual parameter to the RAM 612*a*, the individual parameter being calculated by the calculation part 614, and saving the calculation result to the EEPROM 612*b*.

According to the data collection device 603 of the present invention, data (the parameters) flowing on the in-vehicle network N1 of the working machine 602 can be collected in units of group and in individual units, and further necessary data can be compacted and saved on the basis of the save condition and the calculation condition. The operation data relating to an agricultural operation can be easily obtained when the data collection device 603 is attached to a tractor, a combine, and a rice transplanter, for example.

For example, the parameters, a revolution speed of a rotary, a load of the rotary, an engine revolution speed, a vehicle speed, a depth of plowing, and the like are outputted to the in-vehicle network N1 in a case where a cultivator is coupled as an operation tool to a rear portion of the tractor, and then the tractor is operated. The first obtaining part 611 and the second obtaining part 613 are capable of obtaining the parameters (data), the revolution speed of the rotary, the load of the rotary, the engine revolution speed, the vehicle speed, the depth of plowing, and the like. Meanwhile, the revolution speed of the rotary, the load of the rotary, the engine revolution speed, the vehicle speed, the depth of plowing, and the like are detected by an electronic device (an electric component) 7 such as a sensor attached on the tractor and the cultivator.

Or, in a case where the operation tool coupled to the tractor is a fertilizer distributor, an agricultural chemicals distributor, and a seed distributor, the first obtaining part 611 and the second obtaining part 613 are capable of obtaining the parameters (data) such as the vehicle speed, the engine revolution speed, the distribution amounts (a fertilizer distribution amount, an agricultural chemicals distribution amount, and a seed distribution amount). Meanwhile, the distribution amounts (the fertilizer distribution amount, the agricultural chemicals distribution amount, and the seed distribution amount) are also detected by the electronic devices (the electric components) 7 attached on the tractor, the fertilizer distributor, the agricultural chemicals distributor, and the seed distributor.

In addition, in a case where the operation tool is a harvest machine, the data (the parameter) such as a vehicle speed, an engine revolution speed, a harvest amount are outputted to the in-vehicle network N1, and the vehicle speed, the engine revolution speed, and the harvest amount can be obtained. The harvest amount is also detected by the electronic devices (the electric components) 7 attached on the tractor and the harvest machine.

In this manner, the data collection device 603 is attached on the agricultural machine such as the tractor, and thereby obtaining, as the parameters, the revolution speed of the rotary, the load of the rotary, the engine speed, the vehicle speed, the depth of plowing, the distribution amounts, and the harvest amount.

Meanwhile, in the data collection device 603 described above, the definition storage part 610 saves the definition file including the parameter group, the save condition, the calculation condition, and the like in order to collect the data (the parameter) of the working machine 602; however, the definition file is written to the definition storage part 610 by a manufacturer at the manufacture of the working machine 602.

Figure 17:
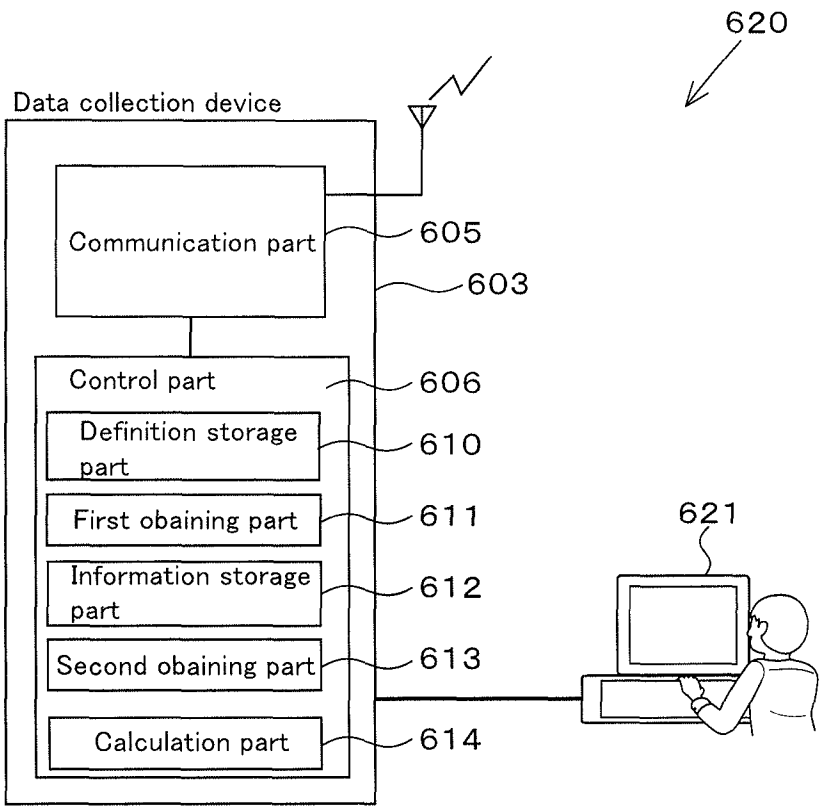
FIG. 17 is an explanation view explaining a first writing system.

FIG. 17 shows an overall view of a system configured to write the conditions to the data collection device 603, that is, a system configured to write the definition file. Configurations different from the embodiment described above will be explained. Meanwhile, the data collection device 603 has a configuration same as the configuration explained in the embodiment described above, and thus an explanation of the data collection device 603 will be omitted.

As shown in FIG. 17, a wiring system 620 includes a computer 621 for writing the conditions to the data collection device 603. The computer 621 includes the definition file corresponding to a machine type of the working machine 602, and writes the definition file to the data collection device 603, the definition file corresponding to a machine type of the working machine 602. For example, the computer 621 writes the definition file including the save condition to the data collection device 603, corresponding to a machine type of the working machine, and writes the definition file including the parameter group, corresponding to a machine type of the working machine 602. Or, the computer 621 writes the definition file including the calculation condition to the data collection device 603, corresponding to a machine type of the working machine 602. Meanwhile, the machine type is a word showing a type of machine; however, in the present embodiment, the machine type includes different models.

Figure 18:
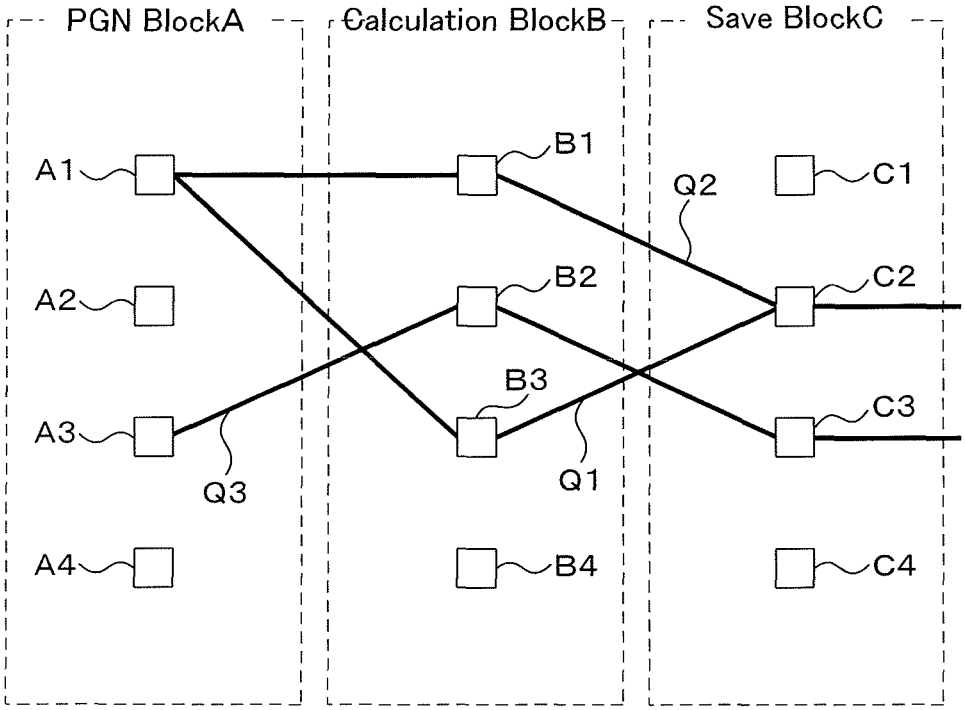
FIG. 18 is an explanation view explaining a configuration of the definition file.

FIG. 18 shows a plurality of the definition files by dividing the definition file into blocks.

As shown in FIG. 18, the definition file (the condition) is configured as a file corresponding to a machine type of the working machine 602 by combining PGN blocks A (A1 to A4), a plurality of calculation blocks B (B1 to B4); and a plurality of save blocks C (C1 to C4) to each other, the PGN blocks A showing different parameter groups (a relationship between the group and the parameter belonging to the group), the calculation blocks B showing different relationships between the ParN (the second identification information of the parameter) and the calculation condition, the save blocks C showing different relationships between the ParN (the second identification information of the parameter) and the save condition.

The computer 621 includes a plurality of the definition files configured of combinations of the PGN blocks A, the calculation blocks B, and the save blocks C each preliminarily prepared. When a machine type of the working machine 602 (a machine type of a working machine being to mount the data collection device 603) is chosen on a monitor of the computer 621, the computer 621 extracts the definition file having the PGN block A, the calculation block B, and the save block C each corresponding to the machine type having been chosen, and writes the definition file having been extracted to the data collection device 603 connected to the computer 621.

For example, in a case where the working machine 602 is a small-size tractor, the computer 621 extracts, from the plurality of definition files, a definition file (an arrowed line Q1) configured of the first PGN block A1, the third calculation block B3, and the second save block C2, and writes the definition file to the data collection device 603, the data collection device 603 being to be attached to the small-size tractor 2. In addition, in a case where the working machine 602 is a large-size tractor, the computer 621 chooses a definition file (an arrowed line Q2) configured of the first PGN block A1, the first calculation block B1, and second save block C3, and writes the definition file to the data collection device 603, the data collection device 603 being to be attached to the large-size tractor 2. In a case where the working machine 602 is a combine, the computer 621 extracts, from the plurality of definition files, a definition file (an arrowed line Q3) configured of the third PGN block A3, the second calculation block B2, and the third save block C3, and writes the definition file to the data collection device 603, the data collection device 603 being to be attached to the combine.

A tractor, a combine, a rice transplanter, and the like are employed as the working machine 602; however, as described above, output conditions of the parameters (for example, an output interval and a bit number of the parameter) outputted to the in-vehicle network N1 are different from each other in the small-size tractor and in the large-size tractor even when the small-size tractor and the large-size tractor are the same type of the working machine 602, that is, the tractor, and accordingly, the data (the parameter) after the calculation can be obtained in a similar form (configuration) by writing, to the data collection device 603, the definition files showing different calculation conditions for each of the machine types. In addition, output conditions of the parameters outputted to the in-vehicle network N1 may be different from each other in a tractor, in a combine, and in a rice transplanter even in agricultural machines, the same category; the definition file is arbitrarily changed corresponding to that, and thereby numerical values of the data collected by the data collection device 603 (the data after the calculation) are unified in a similar form between different machine types.

Fourth Embodiment

A fourth embodiment shows an modified examples of the writing system and of the data collection device 603 of the writing system. Configurations different from the configurations of the third embodiment will be explained.

Figure 19:
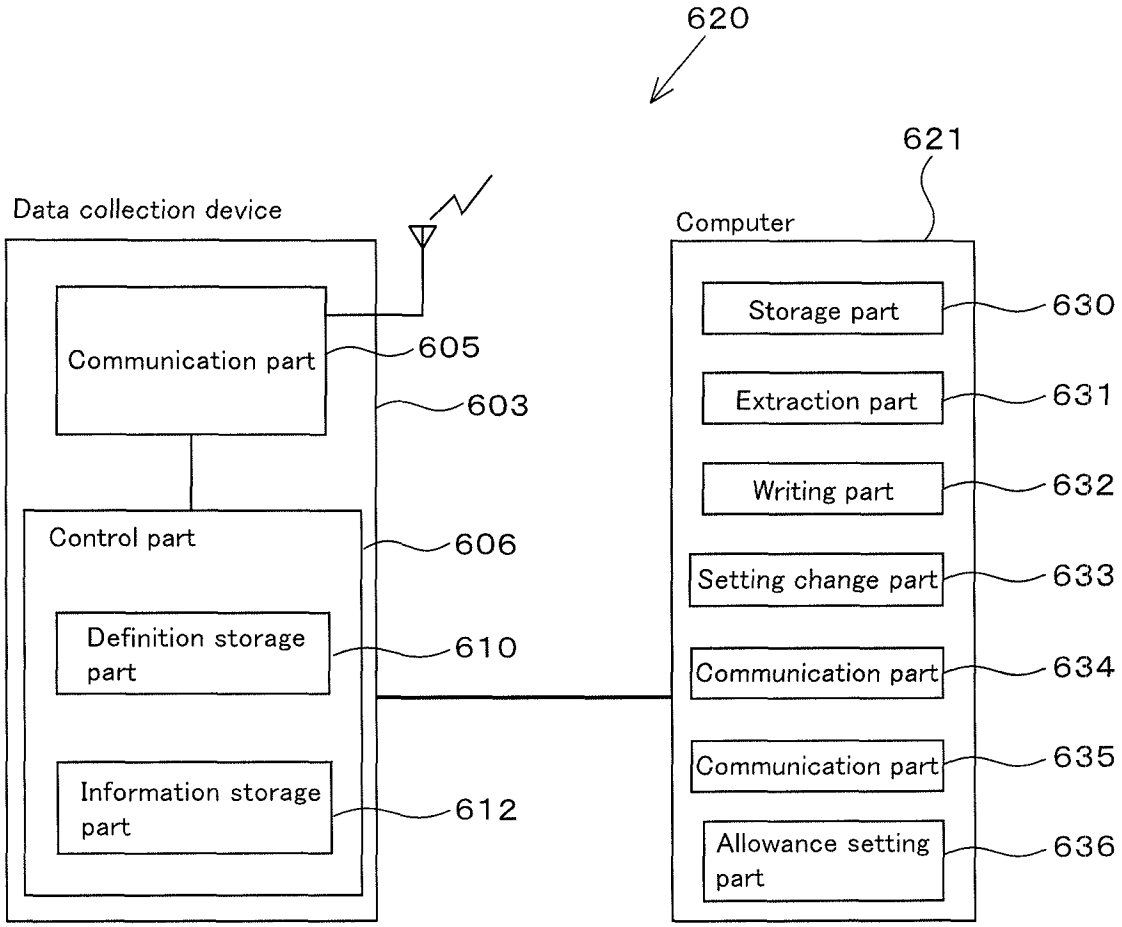
FIG. 19 is an explanation view explaining a second writing system.

As shown in FIG. 19, the writing system 620 includes the data collection device 603 and the computer 621. Firstly, the data collection device 603 will be explained.

The data collection device 603 obtains various types of data outputted from the electronic device (the electric component), the electronic device being mounted on the working machine 602. The electronic device (the electric component) is a sensor, a switch, a CPU, an MPU, or the like as in the third embodiment; however, may be anything mounted on the working machine 602.

Meanwhile, in the third embodiment, the data collection device 603 obtains data through the in-vehicle network, the data being outputted to the in-vehicle network; however, the data collection device 603 according to the fourth embodiment may obtain the data through the in-vehicle network, and may directly obtain, from the electronic device, data outputted from the electronic device. That is, the data collection device 603 according to the embodiment is capable of being connected to the in-vehicle network of the working machine 602 or to the electronic device.

Additionally, in the third embodiment, the data is collected in units of group and in individual units by using a method (a first method) for obtaining the data (the parameter) in units of the data group (the parameter group) and dividing the data group (the parameters) into individual data (the individual parameter), the data group being obtained in units of group; however, in the fourth embodiment, not limited to the first method, a method for obtaining the data in units of group may be employed, and a method for obtaining the data in individual units may be employed, but the data collection may be carried out by using the first method shown in the third embodiment.

As shown in FIG. 19, the data collection device 603 includes the communication part (the input-output part) 605, the control part 606, the definition storage part 610, and the information storage part 612.

The communication part 605 communicates with an outside in wireless, and carries out a communication in wireless, for example, in the Wi-Fi (Wireless Fidelity, registered trademark) of the IEEE802.11 series that is a communication standard. In particular, the communication part 605 converts the data received from the outside into a communication system of the data collection device 603 to output the data to the control part 606, and converts the data sent from the control part 606 into a communication system of the IEEE802.11 series to output the data to the outside. That is, the communication part 605 outputs the data (the signals) received from the outside to the control part 606, and sends, to the outside, the data (the signals) outputted from the control part 606.

The definition storage part 610 and the information storage part 612 are constituted of a nonvolatile memory, for example, an EEPROM. The definition storage part 610 stores a setting condition relating to the collection of data, and the information storage part 612 stores obtained data, a calculation result, and the like.

The control part 606 is constituted of a CPU and the like, and carries out various types of processes relating to data outputted to the electronic device or to the in-vehicle network N1. When the data inputted to the data collection device 603 is data being to be collected, the control part 606 receives the data having been inputted and stores the data to the information storage part 612, and carries out a calculation process by using the data having been inputted. The saving process of and the calculation process of the data are carried out on the basis of a setting condition stored in the definition storage part 610.

For example, when the data, for example, the error existence, the engine revolution speed, and the coolant temperature are inputted to the data collection device 603, the control part 606 sores, to the information storage part 612, the error existence, the engine revolution speed, and the coolant temperature on the basis of the setting condition. In addition, the control part 606 carries out the calculation on the basis of the setting condition by using the error existence, the engine revolution speed, the coolant temperature, and the like each having been obtained.

In addition, in a case where the data sent from an outside to the data collection device 603 is data for rewriting (for example, the definition file having the setting condition), the control part 60 rewrites the definition file stored in the definition storage part 610 when the communication part 605 or the like receives the data for rewriting.

Next, the setting condition will be explained in detail.

The setting condition relating to the collection of data is a condition (the save condition) relating to the data saving or is a condition (the calculation condition) relating to the data calculation. The save condition and the calculation condition are stored in the definition storage part 610 as the definition file.

FIG. 20 collectively shows an example of the setting conditions, that is, the save condition shown in the definition file, and the calculation condition shown in the definition file.

As shown in FIG. 20, the definition file prepares four conditions, that is, "every n times of receiving", "at changing", "every t hours", and "at Key Off", as the save conditions.

Here, the condition "every n times of receiving" shows that the data obtained by the control part 606 is saved to the information storage part 612 every n times when the control part 606 (the data collection device 603) receives the data. In that case, the control part 606 counts the number of obtaining (the number of receiving) a predetermined data (for example, the engine revolution speed), and saves, to the information storage part 612, only a predetermined data (for example, the engine revolution speed) obtained at appoint of time when the number of obtaining reaches n. The number of the obtaining (the number of the receiving) is reset (to an initial value) every n times. Meanwhile, the control part 606 may save, to the information storage part 612, obtained data at a point of time when the number of the obtaining reaches a multiple of n.

The condition "at changing" shows that the data is saved to the information storage part 612 only when the data is changed compared to data previously obtained. In that case, the control part 606 saves the engine revolution speed when the engine speed is changed, for example.

The "every t hours" shows that the data obtained by the control part 606 (the data collection device 603) is saved to the information storage part 612 every time when t hours have passed. In that case, the control part 606 counts time by using a counter or the like, and saves the data every time when t hours have passed after completion of the saving to the information storage part 612.

The "at Key Off" shows that the data obtained by the control part 606 (the data collection device 603) is saved to the information storage part 612 when an engine key (for example, an ignition key) for driving a power source (an engine or the like) is turned off, the power source being mounted on the working machine 602. In that case, the control part 606 monitors the ignition key in collecting the data; thus when the ignition key is turned on, the control part 606 does not save the data having been obtained, and when the ignition key is turned off, the control part 606 saves the data to the information storage part 612.

The four save conditions, that is, the "every n times of receiving", the "at changing", the "every t hours", and the "at Key Off", are shown; however, the save condition is not limited to the examples described above.

In addition, four conditions, that is, "accumulation", "counting", "statistics", and "frequency", are prepared as the calculation conditions in the definition file. Meanwhile, in the explanation of the calculation condition, the data of the engine revolution speed will be explained, for convenience in the explanation.

The "accumulation" shows calculation of a time length where a predetermined data meets a value preliminarily specified (a specified value) in a predetermined time. The specified value is preliminarily determined for each of the predetermined data. For example, assuming that the specified value "800 rpm" is set as the data of the engine revolution speed, the control part 606 calculates the time length where the second parameter meets the "800 rpm" in a predetermined time by using the engine speed having been obtained.

The "counting" shows calculation of the number where a predetermined data meets a value within a range preliminarily specified (a specified range) in a predetermined time. For example, a range "600 rpm to 800 rpm" (a first specified range), a range "801 rpm to 1000 rpm" (a second specified range", a range "1001 rpm to 1500 rpm" (a third specified range), and a range "1501 rpm or more" (a fourth specified range) are set as the specified range of the engine revolution speed.

In that case, the control part 606 calculates the number of meeting the first specified range in a predetermined time, the number of meeting the second specified range in a predetermined time, the number of meeting the third specified range in a predetermined time, and the number of meeting the fourth specified range in a predetermined time by using the engine revolution speed having been obtained.

The "statistics" shows calculation of an average value, the maximum value, and the minimum value of a predetermined data. For example, the control part 606 calculates an average value, the maximum value, and the minimum value of the engine revolution speed obtained in a predetermined time by using the engine revolution speed having been obtained.

The "frequency" shows calculation of a time length where a predetermined data meets a value within a range preliminarily specified (a specified range). For example, assuming that a first specified range, a second specified range, a third specified range, and a fourth specified range are set as the specified range of the engine revolution speed, as in the "counting". In that case, the control part 606 calculates a time length where the engine revolution speed meets a value within the first specified range, a time length where the engine revolution speed meets a value within the second specified range, a time length where the engine revolution speed meets a value within the third specified range, and a time length where the engine revolution speed meets a value within the fourth specified range. Meanwhile, it is preferred to stop the calculation when the second parameter has been out of the specified range preliminarily determined. For example, under a state where the control part 606 calculates a time length satisfying the "801 rpm to 1000 rpm" (the second specified range), the control part 606 completes the calculation of the time length at a point of time when the engine revolution speed having been obtained has been out of the second specified range, for example, 680 rpm, the time length satisfying the second specified range. In this manner, the calculation results calculated under the calculation conditions, the "accumulation", the "counting", the "statistics", and the "frequency" are saved to the information storage part 612 after the completion of the calculation.

FIG. 21 exemplifies a relationship between: the save condition and the calculation condition each described above; and the data in the definition file.

In particular, the identification information is set for each data, and the identification information and the conditions (the save condition and the calculation information) are related to each other, in the definition file. As shown in FIG. 21, a number "11" is set as the identification information to the data of the "error existence", the number "11" showing that the data is the "error existence"; the "at changing" is set as the save condition to the identification information of the "error existence", and the calculation condition is not set (blank).

Additionally, in the definition file, a number "12" is set as the identification information to the data of the "engine revolution speed", the number "12" showing that the data is the "engine revolution speed"; the "every n times of receiving" is set as the save condition to the identification information of the "engine revolution speed", and the "frequency" is set as the calculation condition.

Furthermore, in the definition file, a number "13" is set as the identification information to the data of the "coolant temperature", the number "13" showing that the data is the "coolant temperature"; the "every t hours" is set as the save condition to the identification information of the "coolant temperature", and the "statistics" is set as the calculation condition.

As described above, the save condition preliminarily set is related to the definition file for each of the identification information of data, and the calculation condition preliminarily set is also related to the definition file. Accordingly, when obtaining the data, the data collection device 603, that is, the control part 606 carries out the saving of and the calculating of obtained data to save the data to the information storage part 612 on the basis of the save condition and the calculation condition each related to the data.

Meanwhile, a relationship between the identification information of the data, the save condition, and the calculation condition, that is, the setting condition varies for each of the definition files; as shown in FIG. 19, the plurality of definition files each having different setting conditions are stored in the computer 621, the computer 621 being configured to write the condition to the data collection device 603. In other words, the computer 621 includes a nonvolatile storage part 630 configured to store the plurality of definition file.

Next, the definition files having different setting conditions will be explained in detail.

FIG. 22 exemplifies relationships between the identification information of data, the save condition, and the calculation condition in three definition files.

As shown in FIG. 22, a 1st definition file (a first definition file) sets the save condition "at changing" of the plurality of save conditions to the data of the "error existence" and does not set the calculation condition. In addition, the first definition file sets the save condition "every n times of receiving" of the plurality of save conditions to the data of the "engine revolution speed" and sets the save condition "frequency" of the plurality of calculation conditions to the data. Moreover, the first definition file sets the save condition "every t hours" of the plurality of save conditions to the data of the "coolant temperature" and sets the calculation condition "frequency" of the plurality of calculation conditions to the data. In short, the first definition file is identical to the definition file shown in FIG. 21 mentioned above.

A 2nd definition file (a second definition file) sets the calculation conditions identical to the calculation conditions of the first definition file, and sets not the save condition "every t hours" of the plurality of save conditions but the save condition "every n times of receiving" to the data "coolant temperature".

A 3rd definition file (a third definition file) sets the save conditions identical to the save conditions of the first definition file, and sets not the calculation condition "frequency" of the plurality of calculation conditions but the calculation condition "statistics" to the data "engine revolution speed".

As described above, the storage part 630 of the computer 621 stores the definition files each having different combinations of data types and the setting conditions (the save condition and the calculation condition).

The computer 621 carries out a process of writing the definition file to the data collection device 603 (the definition storage part 610), the definition file corresponding to a machine type of the working machine 602. That is, the storage part 630 of the computer 621 stores the plurality of definition files each having different setting conditions (the save condition and the calculation condition), and the computer 621 carries out a process of writing the definition file corresponding to a machine type of the working machine 602 to the data collection device 603, from among the plurality of definition files.

Next, the computer 621 will be explained in detail.

The computer 621 writes the definition file to the data collection device 603, and is constituted of a personal computer, for example. Meanwhile, the computer 621 may be constituted of a smart phone (a multifunctional mobile phone), a tablet computer, or the like.

The computer 621 is capable of communicating with the data collection device 603 in wired or in wireless. In particular, the computer 621 includes a communication part 634 configured to carry out a wireless communication. The communication part 634 carries out a wireless communication with the communication part 605 of the data collection device 603, that is, carries out a wireless communication in the Wi-Fi (Wireless Fidelity, registered trademark) of the IEEE802.11 series that is a communication standard, and is capable of sending the definition files and the like in wireless to the data collection device 603 (the communication part 605). Or, the computer 621 includes a communication part 635 configured to carry out a communication in wired. The communication part 635 carries out a data communication in wired with the communication part 605 of the data collection device 603, and is capable of sending the definition files and the like to the data collection device 603 (the communication part 605) by connecting the communication part 605 and the communication part 635 to each other with a cable. Meanwhile, in a case where the computer 621 is connected to the data collection device 603 by wire, the communication part 605 (an input-output part) of the data collection device 603 is configured as not only a device for wireless communication but also a device for connecting a LAN, a USB, an RS232C, and the like.

The computer 621 includes an extraction part 631 and a writing part 632. The extraction part 631 and the writing part 632 are constituted of a computer program and the like stored in the computer 621.

The extraction part 631 extracts the definition file corresponding to the working machine 602 from among the plurality of definition files stored in the storage part 630. In particular, the computer 621 is connected to the data collection device 603 in wired or in wireless, and the computer 621 firstly displays a machine type setting screen in writing the definition file to the definition storage part 610 of the data collection device 603, the machine type setting screen being provided for specifying (inputting) the working machine 602. When the machine type is inputted to the machine type setting screen, the extraction part 631 extracts the definition file corresponding to the machine type on the basis of the machine type (a machine type name) inputted to the machine type setting screen.

To be detailed, as shown in FIG. 22, the first definition file, the second definition file, the third definition file, and the machine type name are related to each other, and are stored in the storage part 630. Here, when "M100G" is inputted as the machine type name of the tractor to the machine type setting screen displayed on the computer 621, for example, the extraction part 631 extracts the third definition file corresponding to the "M100G" from the storage part 630.

The writing part 632 writes the definition file to the data collection device 603 being to be attached to the working machine 602, the definition file being extracted by the extraction part 631. For example, as described above, after the extraction part 631 extracts the third definition file corresponding to the "M100G", the writing part 632 sends the third definition file having been extracted to the data collection device 603 connected to the computer 621, and writes the third definition file to the definition storage part 610 of the data collection device 603.

As described above, the writing system 620 according to the fourth embodiment is a system for writing, to the data collection device 603, the setting condition relating to the collection of data, the data collection device 603 being configured to obtain data relating to the working machine, the data being outputted from the working machine 602, and includes the storage part 630 configured to store the plurality of definition files having different setting conditions, the setting conditions being determined for each of data being to be collected. In addition, the writing system 620 includes the extraction part 631 and the writing part 632, the extraction part 631 being configured to extract the definition file corresponding to the working machine 602 from among the plurality of definition files stored in the storage part 630, the writing part 632 being configured to write the definition file to the data collection device 603 being to be attached to the working machine 602, the definition file having been extracted.

Thus, a condition for collection of data corresponding to the working machine 602, that is, the save condition of and the calculation condition of the data can be easily written to the data collection device 603 only by connecting the computer 621 to the data collection device 603 in manufacturing the working machine 602 in a factory or the like, the data collection device 603 being to be mounted on the working machine 602 being to be manufactured.

In particular, the extraction part 631 extracts the definition file corresponding to a machine type of the working machine 602 from among the plurality of definition files. Accordingly, a maker manufacturing the working machine 602, for example, manufactures various types of the working machine 602 such as a tractor, a combine, and a rice transplanter, and the working machines 602 each employ different output intervals of data and different data configurations (a bit number of a signal showing the data); however, the definition files are set for each of machine types of the working machines 602, the definition file corresponding to a machine type is written to the data collection device 603 by using the computer 621, and thereby the data after the collection are shared.

As described above, the data collection device 603 is mounted on the working machine 602, the data collection device 603 having the definition file corresponding to the machine type of the working machine 602, and thereby the data in operation (operation data) of the working machine 602 are easily collected. For example, in a case where the working machine 602 is an agricultural machine such as a tractor, a combine, and the rice transplanter, the operation data generated in an operation of the agricultural machine can be collected.

For example, the operation data such as a revolution speed of a rotary, a load of the rotary, an engine revolution speed, a vehicle speed, a depth of plowing are outputted to the vehicle communication network in a case where a cultivator is coupled as an operation tool to a rear portion of a tractor, and the tractor is operated. The control part 606 is capable of obtaining the operation data such as a revolution speed of a rotary, a load of the rotary, an engine revolution speed, a vehicle speed, a depth of plowing. Meanwhile, the operation data such as a revolution speed of a rotary, a load of the rotary, an engine revolution speed, a vehicle speed, a depth of plowing are detected by an electronic device (an electric component) such as a sensor attached on a tractor and a cultivator.

Or, in a case where the operation tool coupled to the tractor is a fertilizer distributor, an agricultural chemicals distributor, or the seed distributor, the control part 606 is capable of obtaining the operation data such as a vehicle speed, an engine revolution speed, and distribution amounts (a fertilizer distribution amount, the agricultural chemicals distribution amount, and the seed distribution amount). Meanwhile, the distribution amounts (a fertilizer distribution amount, the agricultural chemicals distribution amount, and the seed distribution amount) are also detected by an electronic device (an electric component) attached on a tractor, the fertilizer distributor, the agricultural chemicals distributor, and the seed distributor.

In addition, in a case were the operation tool is a harvest machine, the data such as a vehicle speed, an engine rotation speed, a harvest amount are outputted to the in-vehicle network N1, and the vehicle speed, the engine rotation speed, and the harvest amount can be obtained as the operation data. The harvest amount also can be detected by an electronic device (an electric component) attached on a tractor and a harvest machine.

Meanwhile, it is sometimes required to change: an interval (the save condition in the data collection device 603) of collecting various types of operation data described above (a revolution speed of a rotary, a load of the rotary, an engine revolution speed, a vehicle speed, a depth of plowing, a fertilizer distribution amount, an agricultural chemicals distribution amount, a seed distribution amount, and a harvest amount); and contents (the calculation condition in the data collection device 603) of calculation of the operation data. For example, it is sometimes required to change the save condition of the engine revolution speed from the "every n times of receiving" to the "every t hours".

Accordingly, as shown in FIG. 19, the computer 621 includes a setting change part 633 configured to change the setting condition. The setting change part 633 is constituted of a computer program or the like stored in the computer 621.

The setting change part 633 changes the setting condition corresponding to a predetermined data, and stores, to the storage part 630, the definition file having been changed. Concretely, in a case where the setting condition is changed, the setting change part 633 firstly displays a setting screen M1 on the computer 621 as shown in FIG. 23.

Figure 23:
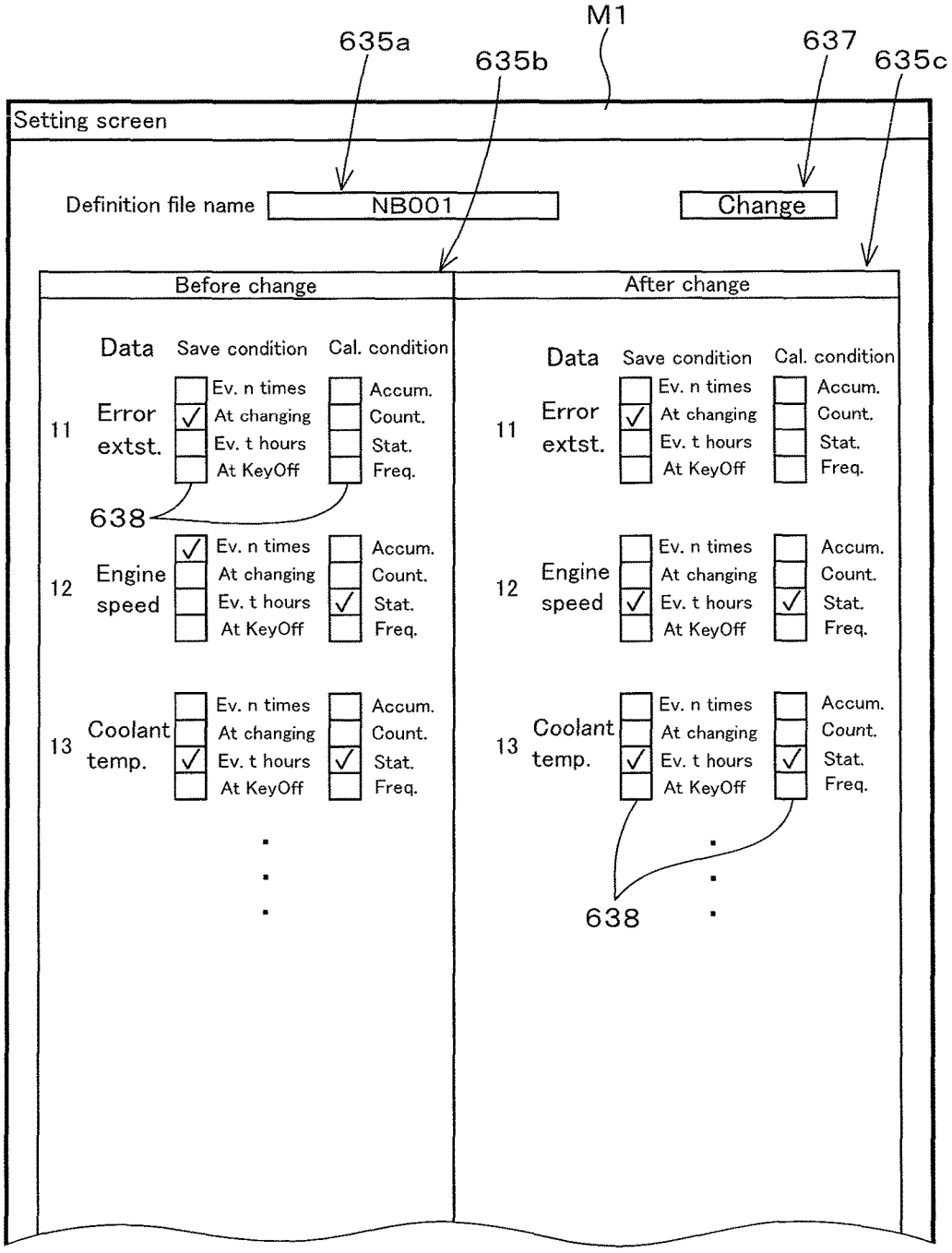
FIG. 23 is an explanation view of a setup screen.

As shown in FIG. 23, the setting screen M1 includes: an input part 635*a* provided for inputting a name of definition file; an unchanged display part 635*b* provided for displaying a setting condition before changing, the setting condition relating to a definition file inputted to the input part 635*a*; and a changed display part 635*c* provided for displaying a setting condition after changing.

The unchanged display part 635*b* and the changed display part 635*c* display the save condition and the calculation condition for each of the data (the identification information), and the changed display part 635*c* is capable of choosing the save condition and the calculation condition.

To be detailed, the unchanged display part 635*b* and the changed display part 635*c* display a check box (a choice part) 638 provided for choosing a condition (an item) for each of the save conditions, and display the check box 638 provided for choosing a condition (an item) for each of the calculation conditions. When the check box 638 is filled in by a check, the save condition and the calculation condition are chosen corresponding to the check box 638.

In a case where a combination of: the data (the identification information) displayed in the unchanged display part 635*b*; and the setting condition (the save condition or the calculation condition) is different from a combination of: the data (the identification information) displayed in the changed display part 635*c*; and the setting condition (the save condition or the calculation condition) in the setting screen M1, the setting change part 633 determines that the definition file inputted to the input part 635*a* is changed, and stores the definition file having a combination of: the data (the identification information) chosen in the changed display part 635*c*; and the setting condition (the save condition or the calculation condition) to the storage part 630.

For example, as shown in FIG. 23, when a file name (NB0001) corresponding to the first definition file is inputted to the input part 635*a*, the setting screen M1 displays the save condition and the calculation condition each corresponding to the first definition file on the unchanged display part 635*a* and the changed display part 635*c*. Here, in a case the check box 638 corresponding to the "every t hours" is filled in by a check in the changed display part 635*c* and a change button 37 displayed on the setting screen M1 is chosen under a state where the unchanged display part 635*b* displays that the save condition of the engine revolution speed is the "every n times of receiving" (the check box 638 corresponding to the "every n times of receiving" is filled in by a check), the setting change part 633 recognizes that the save condition of data corresponding to the engine revolution speed is changed from the "every n times of receiving" to the "every t hours". Then, the setting change part 633 stores the first definition file after changed to the storage part 630. In that case, the setting change part 633 stores the first definition file after changed to the storage part 630, leaving the first definition file before changed without overwriting the first definition file before changed by the first definition file after changed. For example, the setting change part 633 creates a new file name by adding numerals and the like showing a version number to a file name showing the first definition file before changed, and stores the first definition file after changed to the storage part 630 in the new file name. For example, as shown in FIG. 24, a file name of the first definition file after changed is changed to a name "NB0001-ver2", and thus the first definition file after changed is stored in the storage part 630.

As described above, when the definition file is changed, the definition file after changed, that is, the setting condition can be written corresponding to the working machine 602. For example, assuming that the a machine type name "M110C" is inputted to a machine type setting screen M2 shown in FIG. 24B, the extraction part 631 accesses the storage part 630 and extracts a file name of the first definition file corresponding to "M110C". Here, in a case where there are a plurality of file names corresponding to an identical machine type name, the extraction part 631 displays all file names of the first definition file, for example, "NB0001" and "NB0001-ver2" on the machine type setting screen M2. When any one of the file manes is chosen from among the plurality of first definition files displayed on the machine type setting screen M2, the extraction part 631 extracts, from the storage part 630, the first definition file corresponding to the file name having been chosen. For example, when the first definition file having the file name "NB0001-ver2" is chosen in the machine type setting screen M2, the extraction part 631 extracts the first definition file having the file name "NB0001-ver2". Then, the writing part 632 sends the first definition file of "NB0001-ver2" having been extracted to the data collection device 603 connected to the computer 621, and writes the first definition file to the definition storage part 610 of the data collection device 603.

As described above, the writing system 620 includes the setting change part 633 configured to change the setting condition relating to a predetermined data and to store the definition file having been changed to the storage part 630, the extraction part 631 extracts the definition file after changed corresponding to the working machine from among the plurality of definition files stored in the storage part 630, the writing part 632 writes the definition file after changed to the data collection device 603 being to be attached to the working machine 602, the definition file being extracted b the extraction part 631, and thereby the setting condition is changed even after the setting condition has been written to the data collection device 603 once.

Meanwhile, in the above described example, in a case where there are a plurality of definition files corresponding to an identical machine type, the extraction part 631 displays the plurality of definition files on the machine type setting screen M2; however, instead of that, the extraction part 631 may extract only the latest definition file from the storage part 630 in a case where there are the plurality of definition files corresponding to the identical machine type.

And, the fourth embodiment described above displays the plurality of definition files on the machine type setting screen M2 in a case where there are the plurality of definition files corresponding to the identical machine type, thereby choosing the definition file being to be written, and further the definition file having been chosen is written or only the latest definition file is written; however, information may be added to the definition file, the information showing whether the definition file is allowed to be written, and the definition file allowed to be written may be written.

As shown in FIG. 19, the computer 621 includes an allowance setting part 636 configured to set information showing whether the definition file can be written. The allowance setting part 636 is constituted of a computer program or the like stored in the computer 621.

In a case where there are the plurality of definition files corresponding to the identical machine type, the allowance setting part 636 displays a writing setting screen M3 as shown in FIG. 24C, the writing setting screen M3 being configured to set the writing of the definition file. The writing setting screen M3 displays a machine type name and a file name of the definition file, and displays a check box (a choice part) 639 provided for setting whether the writing is permitted, the check box 639 corresponding to each of the file names. When the check box 639 is chosen in the writing setting screen M3, the definition file corresponding to the check box 639 having been chosen can be written. In other words, the storage part 630 stores information relating to allowance of the writing together with the definition file, the information being set in the writing setting screen M3.

In this manner, in a case where the definition file is related to the information showing allowance of the writing of file and is stored in the storage part 630, the extraction part 631 firstly refers to the definition file corresponding to the working machine from among the plurality of definition file stored in the storage part 630. Then, the extraction part 631 extracts only the definition file allowing the writing from among the definition files having been referred to. The writing part 632 sends the definition file allowing the writing to the data collection device 603 being to be attached to the working machine 602, the definition file having been extracted by the extraction part 631, and writes the definition file.

As described above, even in a case where the allowance setting part 636 is disposed to repeatedly change the definition file, thereby creating the plurality of definition flies corresponding to an identical machine type, only a necessary definition file can be written to the data collection device 603 on the basis of various situations by setting allowance of the writing of the definition file on the basis of specifications of data and of a purpose of collecting the data.

Meanwhile, in the embodiment described above, a method of writing the definition file to the data collection device 603 is explained; however, a computer program (a computer program for changing the setting condition) may be written instead of the definition file. That is, the computer program can be written to the data collection device 603 by reading the computer program as the definition file described above.

That is, the writing system 620 may include the storage part 630 configured to store a plurality of computer programs each having different setting conditions determined for each of data being to be collected. In addition, the writing system 620 may include the extraction part 631 and the writing part 632, the extraction part 631 being configured to extract a program corresponding to the working machine from among a plurality of programs stored in the storage part 630, the writing part 632 being configured to write the program extracted by the extraction part 631 to the data collection device 603 being to be attached to the working machine 602. Moreover, the extraction part 631 may extract the program corresponding to a machine type of the working machine 602 from among the plurality of programs.

Furthermore, the writing system 620 may include the setting change part 633 configured to change the setting condition corresponding to a predetermined data and to store the program having been changed to the storage part 630. The extraction part 631 may extract the program having been changed corresponding to the working machine from among the plurality of programs stored in the storage part 630, and the writing part 632 may write the program after changed to the data collection device 603 being to be attached to the working machine 602, the program being extracted by the extraction part 631. In addition, the writing system 620 may include the allowance setting part 636 configured to set information showing whether the program can be written.

Meanwhile, all the features of the embodiments disclosed in this application should be considered just as examples, and the embodiments do not restrict the present invention accordingly. A scope of the present invention is shown not in the above-described embodiments but in claims, and is intended to include all modifications within and equivalent to a scope of the claims.

In the embodiments described above, the operation data sent from the mobile terminal 3*a* to the server 2 is accumulated in the collection data accumulation part 21 of the server 2, and the operation data sent from the mobile terminal 3*b* to the server 2 is also accumulated in the collection data accumulation part 21 of the server 2. Modifying the configuration, the mobile terminal 3*a* may include the collection data accumulation part 21, and the mobile terminal 3*b* may include the collection data accumulation part 21; also in this manner, consistency of the operation data accumulated in the collection data accumulation part 21 can be ensured certainly.

Additionally, in the embodiments described above, the working machine includes the hour meter that is a total operation time; however, the present invention can be applied to a working machine including no hour meter. In the embodiments described above, the data collection device 5 collects the operation data after relating the hour meter to the operation data; however, the data collection device 5 may collect the operation data after relating index information (for example, an index number) to the operation data instead of the hour meter, the index information being used for sorting the operation data having been collected. In that case, the data collection processing part 56 stops updating the index information when a checking between the first identification information and the second identification information is unsuccessful.

In the embodiments described above, items showing different modes (methods) of the save conditions are exemplified, for example; in a case where contents shown in the save conditions are slightly different, the save conditions may be considered to be different conditions even when the modes (methods) of the save conditions are identical.

For example, in the save conditions, the "every n times of receiving" and the "at changing" each apparently show different modes (methods) of the save conditions; however, in the "every n times of receiving", the save condition may be considered to be different conditions when "n" has different numerical values. That is, since the intervals of the saving are different in "every 3 times of receiving" and in "every 10 times of receiving", the save conditions are considered to be different conditions, and thus the save conditions each having different numerical values "n" may be prepared for each of the machine types. Meanwhile, in the save condition, it is preferred to change, on the setting screen M1, the numerical value of "n" showing the number of receiving; and the numerical value of "t" showing a time.

Similarly, in a case where contents shown in the calculation conditions are slightly different, the calculation conditions may be considered to be different conditions even when the modes (methods) of the calculation conditions are identical. For example, in the calculation conditions, the "accumulation" and the "frequency" each apparently show different modes (methods) of the calculation conditions; however, in the "frequency", the calculation condition may be considered to be different conditions when the "specified range" has different numerical values. That is, since the ranges are different in the first specified range "600 rpm to 800 rpm" and in the first specified range "580 rpm to 800 rpm", the calculation conditions are considered to be different conditions, and thus the calculation conditions each having different specified ranges of numerical values may be prepared for each of the machine types. Meanwhile, in the calculation condition, it is preferred to change, on the setting screen M1, the numerical values of the specified ranges shown in the "counting" and the "frequency"; and the specified value shown in the "counting".

DESCRIPTION OF THE REFERENCE NUMERAL

1. Data collection system
2. Server
3*a*, 3*b*. Mobile terminal
4*a*, 4*b*. Agricultural machine (Tractor)
5*a*, 5*b*. Data collection device
6*a*, 6*b*. Control device
21. Collection data accumulation part
31*a*, 31*b*. Second communication part
32*a*, 32*b*. Data request part
51*a*, 51*b*. Identification information retention part
53*a*, 53*b*. Collection data retention part
54*a*, 54*b*. Hour meter
55*a*, 55*b*, 55*c*, 55*d*. Check part
56*a*, 56*b*, 56*c*, 56*d*. Data collection processing part
57*a*, 57*b*. Communication part
61*a*, 61*b*. Agricultural machine identification information
Ua, Ub. Operator
N. Network
R. Relay station
210, 211, 220, 221, 230. Collection data group

The invention claimed is:

1. A data collection device of a working machine, the data collection device being connected to an in-vehicle network of the working machine and being configured to obtain data outputted from an electric component, the electric component being connected to the in-vehicle network, comprising:

a definition storage part configured to store a data group showing a relation between a group preliminarily determined relating to data to be outputted from the electric component and the data to be outputted from the electric component belonging to the group;

a first obtaining part configured to obtain, in group units, the data belonging to the group shown in the data group;

a second obtaining part configured to separate, into individual units, the data of the group units obtained by the first obtaining part, and to obtain the data separated into individual units;

an input-output part configured to output, to the outside: the data of the group units obtained by the first obtaining part; and the data of the individual units obtained by the second obtaining part;

an information storage part configured to store the data obtained by the first obtaining part and the second obtaining part; and a calculation part configured to calculate individual data that is the data of the individual units, wherein the definition storage part stores a definition file including a calculation condition under which the individual data is calculated, the definition file relating first identification information, second identification information, and an individual calculation condition to each other, the first identification information being provided for identifying the group, the second identification information being provided for identifying individual data that is the data of individual units, the individual calculation condition being a condition to save the individual data, resulting from a calculated parameter, in the information storage part, the first obtaining part stores, in group units, the data of the group units to the information storage part after obtaining the data of the group units, the second obtaining part divides the data of the group units obtained by the first obtaining part into the data of the individual units after the first obtaining part obtains the data of the group units, extracts the individual calculation condition of the individual data based on: the first identification information of the group of the divided individual data; the second identification information of the individual data; and the definition file, and saves the individual data to the information storage part in isolation from the data of the group units, the individual data, resulting from the calculated parameter, being calculated based on the extracted individual calculation condition in the information storage part based on the extracted individual calculation condition, the calculation part calculates a time length where the individual data meets a value within a first specified range, a time length where the individual data meets a value within a second specified range, a time length where the individual data meets a value within a third specified range, and a time length where the individual data meets a value within a fourth specified range, under a state where the second obtaining part continuously obtains the individual data, and the information storage part stores a calculation result of the individual data calculated by the calculation part.

2. The data collection device of the working machine according to claim 1, wherein the input-output part configured to output, to the outside of the data collection device, the calculation result of the individual data stored in the information storage part.

3. A data collection device of a working machine, the data collection device being connected to an in-vehicle network of the working machine and being configured to obtain data outputted from an electric component, the electric component being connected to the in-vehicle network, comprising:

a definition storage part configured to store a data group showing a relation between a group preliminarily determined relating to data to be outputted from the electric component and the data to be outputted from the electric component belonging to the group;

a first obtaining part configured to obtain, in group units, the data belonging to the group shown in the data group;

a second obtaining part configured to separate, into individual units, the data of the group units obtained by the first obtaining part, and to obtain the data separated into individual units;

an input-output part configured to output, to the outside: the data of the group units obtained by the first obtaining part; and the data of the individual units obtained by the second obtaining part;

an information storage part configured to store the data obtained by the first obtaining part and the second obtaining part; and a calculation part configured to calculate individual data that is the data of the individual units, wherein the definition storage part stores a definition file including a calculation condition under which the individual data is calculated, the definition file relating first identification information, second identification information, and an individual calculation condition to each other, the first identification information being provided for identifying the group, the second identification information being provided for identifying individual data that is the data of individual units, the individual calculation condition being a condition to save the individual data, resulting from a calculated parameter, in the information storage part, the first obtaining part stores, in group units, the data of the group units to the information storage part after obtaining the data of the group units, the second obtaining part divides the data of the group units obtained by the first obtaining part into the data of the individual units after the first obtaining part obtains the data of the group units, extracts the individual calculation condition of the individual data based on: the first identification information of the group of the divided individual data; the second identification information of the individual data; and the definition file, and saves the individual data to the information storage part in isolation from the data of the group units, the individual data, resulting from the calculated parameter, being calculated based on the extracted individual calculation condition in the information storage part based on the extracted individual calculation condition, the calculation part calculates a number of meeting a first specified range in a predetermined time, a number of meeting a second specified range in a predetermined time, a number of meeting a third specified range in a predetermined time, and a number of meeting a fourth specified range in a predetermined time, and the information storage part stores a calculation result of the individual data calculated by the calculation part.

4. The data collection device of the working machine according to claim 3, wherein the input-output part configured to output, to the outside of the data collection device, the calculation result of the individual data stored in the information storage part.

* * * * *